US008992306B2

(12) United States Patent
Iddings et al.

(10) Patent No.: US 8,992,306 B2
(45) Date of Patent: Mar. 31, 2015

(54) GAMING SYSTEM AND METHOD PROVIDING VARIABLE PAYBACK PERCENTAGES

(75) Inventors: Cara L. Iddings, Las Vegas, NV (US); Brad Robert Steinbach, legal representative, Las Vegas, NV (US); Richard J. Schneider, Las Vegas, NV (US); Daniel J. DeWaal, Las Vegas, NV (US); Anthony J. Baerlocher, Las Vegas, NV (US)

(73) Assignee: IGT, Las Vegas, NV (US)

( * ) Notice: Subject to any disclaimer, the term of this patent is extended or adjusted under 35 U.S.C. 154(b) by 922 days.

(21) Appl. No.: 12/147,225

(22) Filed: Jun. 26, 2008

(65) Prior Publication Data

US 2009/0088239 A1 Apr. 2, 2009

Related U.S. Application Data

(60) Provisional application No. 60/952,795, filed on Jul. 30, 2007.

(51) Int. Cl.
*A63F 9/24* (2006.01)
*G07F 17/32* (2006.01)

(52) U.S. Cl.
CPC ..... *G07F 17/3239* (2013.01); *G07F 17/3244* (2013.01)
USPC ..... 463/25; 463/16; 463/20; 463/29

(58) Field of Classification Search
CPC ..... G07F 17/3255; G07F 17/34
See application file for complete search history.

(56) References Cited

U.S. PATENT DOCUMENTS 4,743,022 A 5/1988 Wood
5,019,973 A 5/1991 Wilcox et al.
5,123,649 A 6/1992 Tiberio (Continued)

FOREIGN PATENT DOCUMENTS

AU 200065501 B2 3/2001
EP 1 004 970 5/2000

(Continued)

OTHER PUBLICATIONS

Bally Live-Server Based Gaming brochure, written by Bally Gaming Systems, published in 2006.

(Continued)

*Primary Examiner* — Lawrence Galka
(74) *Attorney, Agent, or Firm* — Neal, Gerber & Eisenberg LLP

(57) ABSTRACT

A gaming system and method is disclosed which provides variable payback or hold amounts for a primary or base game, a secondary or bonus game, or both. The gaming system includes a central controller that changes at least one aspect of the game to provide a variable payback or hold for a gaming device in the gaming system. The gaming system includes a plurality of different paytables or award sequences each having a different average expected payback. The gaming system selects one of the paytables or award sequences for the game based on a player ranking assigned to each player. The player ranking is associated with a player tracking status obtained through a suitable player tracking system. The selection of one of the paytables or award sequences and its associated average expected payback is based on the player ranking (i.e., the player tracking status) of the player.

50 Claims, 10 Drawing Sheets

(56) References Cited

U.S. PATENT DOCUMENTS 5,248,142 A 9/1993 Breeding
5,393,067 A 2/1995 Paulsen et al.
5,401,023 A 3/1995 Wood
5,511,781 A 4/1996 Wood et al.
5,570,885 A 11/1996 Ornstein
5,586,766 A 12/1996 Forte et al.
5,630,753 A 5/1997 Fuchs
5,655,961 A 8/1997 Acres et al.
5,719,431 A 2/1998 Werner
5,766,076 A 6/1998 Pease et al.
5,788,574 A 8/1998 Ornstein et al.
5,806,855 A 9/1998 Cherry
5,833,540 A 11/1998 Miodunski
5,839,730 A 11/1998 Pike
5,851,010 A 12/1998 Feinberg
5,911,418 A 6/1999 Adams
5,967,893 A 10/1999 Lawrence et al.
6,004,207 A 12/1999 Wilson, Jr. et al.
6,039,648 A 3/2000 Guinn et al.
6,050,895 A 4/2000 Luciano, Jr. et al.
6,062,981 A 5/2000 Luciano, Jr.
6,068,552 A 5/2000 Walker et al.
6,077,163 A 6/2000 Walker et al.
6,135,884 A 10/2000 Hedrick et al.
6,155,925 A 12/2000 Giobbi et al.
6,159,097 A 12/2000 Gura
6,186,894 B1 2/2001 Mayeroff
6,203,429 B1 3/2001 Demar et al.
6,224,483 B1 5/2001 Mayeroff
6,231,442 B1 5/2001 Mayeroff
6,254,483 B1 7/2001 Acres
6,267,669 B1 7/2001 Luciano, Jr. et al.
6,290,603 B1 9/2001 Luciano, Jr.
6,319,125 B1 11/2001 Acres
6,358,147 B1 3/2002 Jaffe et al.
6,364,768 B1 4/2002 Acres et al.
6,375,570 B1 4/2002 Poole
6,419,578 B1 7/2002 Moody et al.
6,425,823 B1 7/2002 Byrne
6,468,156 B1 10/2002 Hughs-Baird et al.
6,517,073 B1 2/2003 Vancura
6,569,013 B1 5/2003 Taylor
6,589,115 B2 7/2003 Walker et al.
6,607,195 B2 8/2003 Vancura
6,612,927 B1 9/2003 Slomiany et al.
6,702,289 B1 3/2004 Feola
6,702,675 B2 3/2004 Poole et al.
6,712,693 B1 3/2004 Hettinger
6,746,016 B2 6/2004 Perrie et al.
6,802,778 B1 10/2004 Lemay et al.
6,857,957 B2 2/2005 Marks et al.
6,857,959 B1 2/2005 Nguyen
7,029,395 B1 4/2006 Baerlocher
7,056,215 B1 6/2006 Olive
7,115,033 B1 10/2006 Timperley
7,198,569 B2 4/2007 Wolf et al.
7,291,068 B2 11/2007 Bryant et al.
7,318,774 B2 1/2008 Bryant et al.
7,326,115 B2 2/2008 Baerlocher
7,329,179 B2 2/2008 Baerlocher
7,361,085 B2 * 4/2008 Packes et al. ..... 463/16
7,384,337 B2 6/2008 Thomas
7,402,101 B2 7/2008 Casey
7,419,429 B2 9/2008 Taylor
7,427,233 B2 9/2008 Walker et al.
7,465,229 B2 12/2008 Shuster
7,661,678 B2 * 2/2010 Snow ..... 273/292
7,967,674 B2 6/2011 Baerlocher
2001/0054794 A1 12/2001 Cole et al.
2001/0055990 A1 * 12/2001 Acres ..... 463/25
2002/0058546 A2 5/2002 Acres et al.
2002/0111210 A1 * 8/2002 Luciano et al. ..... 463/29
2002/0193158 A1 12/2002 Weiss et al.
2003/0032474 A1 * 2/2003 Kaminkow ..... 463/25
2003/0073488 A1 * 4/2003 Okita et al. ..... 463/30
2003/0078101 A1 4/2003 Schneider et al.
2003/0100360 A1 * 5/2003 Manfredi et al. ..... 463/25
2003/0207713 A1 11/2003 Taylor
2004/0023713 A1 2/2004 Wolf et al.
2004/0038724 A1 2/2004 Asdale
2004/0076503 A1 4/2004 Rau et al.
2004/0242313 A1 * 12/2004 Munoz ..... 463/20
2004/0248648 A1 * 12/2004 Rothschild et al. ..... 463/31
2005/0009597 A1 1/2005 Daly
2005/0054429 A1 3/2005 Baerlocher et al.
2005/0060050 A1 3/2005 Baerlocher
2005/0071023 A1 3/2005 Gilliland et al.
2005/0096121 A1 5/2005 Gilliland et al.
2005/0096123 A1 5/2005 Cregan et al.
2005/0143166 A1 * 6/2005 Walker et al. ..... 463/25
2005/0153773 A1 7/2005 Nguyen et al.
2005/0208992 A1 9/2005 Randall
2005/0239546 A1 10/2005 Hedrick et al.
2005/0282635 A1 12/2005 Aoki
2006/0025193 A1 2/2006 Gail et al.
2006/0040723 A1 2/2006 Baerlocher et al.
2006/0040728 A1 2/2006 Fuller
2006/0040732 A1 2/2006 Baerlocher et al.
2006/0040733 A1 2/2006 Baerlocher et al.
2006/0040734 A1 2/2006 Baerlocher et al.
2006/0040735 A1 * 2/2006 Baerlocher ..... 463/26
2006/0040736 A1 2/2006 Baerlocher et al.
2006/0046832 A1 3/2006 Isogai et al.
2006/0048616 A1 3/2006 Grenier et al.
2006/0063580 A1 3/2006 Nguyen et al.
2006/0068883 A1 3/2006 Randall et al.
2006/0084496 A1 * 4/2006 Jaffe et al. ..... 463/20
2006/0252515 A1 11/2006 Walker et al.
2006/0281541 A1 12/2006 Nguyen et al.
2007/0021182 A1 1/2007 Gauselmann
2007/0060246 A1 3/2007 Baerlocher et al.
2007/0087804 A1 4/2007 Knowles et al.
2007/0087818 A1 * 4/2007 Walker et al. ..... 463/25
2007/0105619 A1 5/2007 Kniesteadt et al.
2007/0117608 A1 * 5/2007 Roper et al. ..... 463/16
2007/0117616 A1 5/2007 Bartholomew
2007/0135207 A1 6/2007 Tarantino
2007/0167226 A1 * 7/2007 Kelly et al. ..... 463/29
2007/0191102 A1 * 8/2007 Coliz et al. ..... 463/42
2007/0270213 A1 11/2007 Nguyen et al.
2007/0287532 A1 12/2007 Jackson
2007/0293293 A1 12/2007 Baerlocher et al.
2007/0298857 A1 12/2007 Schlottmann et al.
2008/0009334 A1 * 1/2008 Walker et al. ..... 463/16
2008/0020847 A1 1/2008 Kniesteadt et al.
2008/0032787 A1 2/2008 Low et al.
2008/0045344 A1 2/2008 Schlottmann et al.
2008/0064502 A1 3/2008 Schlottmann et al.
2008/0070676 A1 3/2008 Baerlocher et al.
2008/0070677 A1 3/2008 Baerlocher et al.
2008/0070678 A1 3/2008 Baerlocher et al.
2008/0070680 A1 3/2008 Baerlocher et al.
2008/0070693 A1 3/2008 Schlottmann et al.
2008/0070695 A1 3/2008 Baerlocher et al.
2008/0076496 A1 3/2008 Baerlocher et al.
2008/0076503 A1 3/2008 Mattice et al.
2008/0076527 A1 3/2008 Low et al.
2008/0076531 A1 3/2008 Baerlocher et al.
2008/0076532 A1 3/2008 Graham et al.
2008/0076534 A1 3/2008 Iddings et al.
2008/0076542 A1 3/2008 Iddings et al.
2008/0076576 A1 3/2008 Graham et al.
2008/0081689 A1 * 4/2008 Seelig et al. ..... 463/23
2008/0081690 A1 4/2008 Baerlocher et al.
2008/0081691 A1 4/2008 Baerlocher et al.
2008/0085771 A1 4/2008 Iddings et al.
2008/0085772 A1 4/2008 Iddings et al.
2008/0102916 A1 * 5/2008 Kovacs et al. ..... 463/16
2008/0102935 A1 5/2008 Finnimore
2008/0108423 A1 5/2008 Benbrahim et al.
2008/0113771 A1 5/2008 Baerlocher et al.
2008/0113779 A1 * 5/2008 Cregan ..... 463/27
2008/0113810 A1 * 5/2008 Kubota et al. ..... 463/42
2008/0139274 A1 6/2008 Baerlocher

(56) References Cited

U.S. PATENT DOCUMENTS

| | | | | |
|---|---|---|---|---|
| 2008/0139290 | A1 | 6/2008 | Kniesteadt et al. | |
| 2008/0153564 | A1 | 6/2008 | Baerlocher et al. | |
| 2008/0176645 | A1 | 7/2008 | Griswold et al. | |
| 2008/0214292 | A1 | 9/2008 | Bryant et al. | |
| 2009/0181758 | A1* | 7/2009 | Loose et al. | 463/20 |
| 2010/0144415 | A1* | 6/2010 | Wolf et al. | 463/13 |
| 2010/0160031 | A1* | 6/2010 | Gilliland et al. | 463/20 |
| 2010/0227678 | A1* | 9/2010 | Konishi et al. | 463/29 |
| 2011/0118004 | A1* | 5/2011 | Kelly et al. | 463/20 |

FOREIGN PATENT DOCUMENTS

| | | | |
|---|---|---|---|
| EP | 1 378 873 | | 1/2004 |
| WO | WO 9835309 | | 8/1998 |
| WO | WO 9941718 | | 8/1999 |
| WO | WO 9965579 | | 12/1999 |
| WO | WO 0025281 | | 5/2000 |
| WO | WO 0161437 | | 8/2001 |
| WO | WO 03045515 | | 6/2003 |
| WO | WO 03045516 | | 6/2003 |
| WO | WO 2004004855 | | 1/2004 |
| WO | WO 2004103495 | | 12/2004 |
| WO | 2005010831 | A2 | 2/2005 |
| WO | WO 2005028056 | | 3/2005 |
| WO | WO 2005029220 | | 3/2005 |
| WO | WO 2005033825 | | 4/2005 |
| WO | WO 2005033826 | | 4/2005 |
| WO | WO 2005120672 | | 12/2005 |
| WO | 2006002241 | A2 | 1/2006 |
| WO | 2006004831 | A2 | 1/2006 |
| WO | WO 2006017036 | | 2/2006 |
| WO | WO 2006027677 | | 3/2006 |
| WO | WO 2006039067 | | 4/2006 |
| WO | 2007090270 | A1 | 8/2007 |
| WO | WO 2008057325 | | 5/2008 |

OTHER PUBLICATIONS

Bonusing Solutions without Limits brochure, written by Bally Gaming Systems, published in 2005.

Jackpot Carnival Hyperlink Advertisement, written by Aristocrat, published prior to 2002.

Player Tracking on Slots, written by GRIPS Electronic GmbH, printed from website reported as archived on Feb. 20, 1997 (available at http://web.archive.org/web/19970220165921/www.grips.com/playtrac.htm).

Server Based: Other Possibilities Article; published by www.casinocenter.com in May 2006.

SB Products—The Next Big Innovation, printed from www.igt.com in Aug. 2006.

Transforming Gaming brochure, written by Cyberview Technology, published in 2006.

* cited by examiner

FIG. 5A

Paytable A 202a

| Winning Symbol Combination | Award |
|---|---|
| AAAAA | 50 |
| BBBBB | 100 |
| CCCCC | 1,000 |
| DDDDD | 5,000 |

Average Expected Payback 90%

FIG. 5B

Paytable B 202b

| Winning Symbol Combination | Award |
|---|---|
| AAAAA | 100 |
| BBBBB | 500 |
| CCCCC | 3,000 |
| DDDDD | 50,000 |

Average Expected Payback 92%

FIG. 5C

Paytable C 202c

| Winning Symbol Combination | Award |
|---|---|
| AAAAA | 100 |
| BBBBB | 500 |
| CCCCC | 2,000 |
| DDDDD | 75,000 |

Average Expected Payback 93%

FIG. 5D

Paytable D 202d

| Winning Symbol Combination | Award |
|---|---|
| AAAAA | 500 |
| BBBBB | 200 |
| CCCCC | 2,000 |
| DDDDD | 5,000 |

Average Expected Payback 95%

GAMING SYSTEM AND METHOD PROVIDING VARIABLE PAYBACK PERCENTAGES

PRIORITY CLAIM

This application is a non-provisional application of, claims priority to and the benefit of U.S. Provisional Patent Application Ser. No. 60/952,795 filed on Jul. 30, 2007, the entire contents of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines that provide players awards in primary or base games are well known. Gaming machines generally require the player to place or make a wager to activate the primary or base game. In many of these gaming machines, the award is based on the player obtaining a winning symbol or symbol combination and on the amount of the wager (i.e., the higher the wager, the higher the award). Winning symbols or symbol combinations are typically displayed to the player by a paytable. The paytable determines an average expected return for the primary or base game. The paytable usually provides: (i) lower awards for symbols or symbol combinations, which are more likely to occur in the primary game, and (ii) higher awards for symbols or symbol combinations less likely to occur in the primary game.

Secondary or bonus games are also known in gaming machines. These secondary or bonus games usually provide an additional award to the player. Such bonus awards are accounted for when determining the overall paytable for the gaming machine. Secondary or bonus games usually do not require an additional wager by the player to be activated. Secondary or bonus games are often activated or triggered upon an occurrence of a designated triggering symbol or triggering symbol combination in the primary or base game of the gaming machine. For instance, a bonus symbol occurring on a payline on the third reel of a three reel slot machine triggers the secondary bonus game on that gaming device. Part of the enjoyment and excitement of playing certain gaming machines is the occurrence or triggering of the secondary or bonus game (even before the player knows how much the bonus award will be). In other words, obtaining a bonus event and a bonus award in the bonus event is part of the enjoyment and excitement for players.

Most gaming machines are set to pay back on average a certain percentage of the amount of money wagered by players. The average percentage of money wagered that is paid back to the player is sometimes called the average return, the average expected payback or the average expected payback percentage. The average payback provided by a game is determined by the paytable of that game. For a slot game, a paytable determines which awards will be provided to a player if certain winning symbols or winning symbol combinations appear on an activated or wagered on payline.

Similarly, most gaming machines are set to hold on average a certain percentage of the amount of money wagered by players. The average percentage of money wagered that is held by the gaming device is sometimes called the average expected hold or the average expected hold percentage. The average expected hold percentage and the average expected payback percentage constitute on average 100% of the money wagered on the gaming machine. Gaming machines with a higher average expected payback have a lower average expected hold and vice versa.

Most games played at existing gaming machines have paytables which include predetermined winning symbol combinations or events. As a result, such games also have paytables with predetermined average expected paybacks. In such existing gaming machines, the amount of the wager made on the primary or secondary games by the player may vary while the average expected payback (or the average expected hold) for such primary or secondary games remains constant. Accordingly, gaming establishments are in need of new and exciting ways to provide variable average expected returns and average expected holds (i.e., better paybacks and less holds) to players as part of their gaming experience.

Player tracking systems are also known. Player tracking systems enable gaming establishments to recognize the value of customer loyalty through identifying frequent customers and rewarding them for their patronage. The cumulative history of a particular player's gaming activity, which is included in a player profile, enables gaming establishments to target individual players with direct marketing promotions or customized compensation plans. In existing player tracking systems, a player is issued a player identification card which has an encoded player identification number that uniquely identifies the player. Player tracking on gaming devices such as slot machines, is typically accomplished with a card reader mounted to the gaming device. When the player first sits down at a gaming device, the player inserts the card into the card reader. The card reader reads the player identification number off the player tracking card and communicates information through a network to a central computer regarding the player's subsequent gaming activity. Based on this communicated information or data, the gaming establishment classifies each player and provides one or more of such players certain benefits based on these classifications and amounts wagered by the player.

Gaming establishment or casino loyalty programs are also well known. A casino loyalty programs works in conjunction with a player tracking system to offer incentives to players in exchange for the player's loyalty to and play history at the gaming establishment. Such loyalty incentives are often provided and funded by the gaming establishment's marketing department. These marketing department promotions are not accounted for in determining the overall paytable for the gaming machines.

One known way to provide loyalty incentives to players is by offering promotional credits (delivered as either direct mail offers or as a result of a loyalty bonus) to be utilized in one or more wagering games. Such promotional credits are often offered as a one-time event such as for a player signing up for a player tracking card. These promotions represent a cost to the gaming establishment. However, such promotions or the benefits thereof are often not easily noticed by players because such promotions usually run for a short time period. That is, very few players notice the promotional credits unless the casino or gaming establishment notifies or informs these players in an extra manner. Thus, even though the casino or gaming establishment pays for the promotion, the casino or gaming establishment often does not realize all of the benefits from such promotions. Accordingly, gaming establishments are in need of new and exciting ways to provide awards to loyal players as part of their gaming experience.

More specifically, there is a continuing need to provide a gaming establishment with options for more types of frequent player or loyalty incentives. Such loyalty offerings should: be adjustable in amount and triggering frequency to meet the level of the player's loyalty (i.e., frequent or loyal players deserve more frequent or larger awards); and be viewed as a loyalty offering provided by the gaming establishment and/or the gaming machine manufacturer. Additionally, if possible, such loyalty offerings should: be viewed as being more valuable or enticing than promotional credits; and provide a mechanism or way for the gaming establishment and/or the gaming machine manufacturer to know and control costs associated with awarding such loyalty offerings.

Accordingly, there is a continuing need to provide new and different gaming machines and gaming systems as well as new and different ways to vary the expected payback of designated loyalty offerings to certain players.

SUMMARY

The gaming system and method disclosed herein provides players at gaming devices with variable average expected returns, or variable average expected holds, based on an individual player's status or ranking. In one embodiment, the gaming system determines an individual status or an individual ranking for a player that is currently playing at a gaming machine in the gaming system. In one such embodiment, the gaming machine determines the average expected return (or the average expected hold) for the gaming device based on the individual status or individual ranking of the player. That is, the gaming system first determines a player ranking for the player and second determines whether to change the average expected payback percentage (or the average expected hold percentage) of the gaming machine being played by the player based on the determined player ranking.

In one embodiment, the gaming system determines the individual player ranking in association with a suitable player tracking system. The player tracking system assigns a player status or a player ranking to each player of each gaming machine in the gaming system. In one embodiment, the player status or player ranking is at least partially based on the player's loyalty to a certain gaming establishment. In different instances, the player's loyalty is shown in different ways, such as through the amount of money wagered during one or more particular gaming sessions, or the amount of money spent during one or more particular stays at the gaming establishment. Based on this player ranking, the gaming system determines whether to change the average expected payback percentage (or the average expected hold percentage) of the gaming machine being played by the player based on the player's status or ranking.

In different embodiments, the gaming system changes the average expected payback percentage (or the average expected hold percentage) of the gaming machine being played by the player. To change the average expected payback percentage (or the average expected hold percentage), the gaming system changes the game being played by the player or at least one aspect associated with the game. In different embodiments, such aspects include at least one displayed paytable associated with the game being played by the player, at least one mapping of a paytable associated with the game being played by the player, at least one award sequence associated with the game, an eligibility to play the game, or any combination thereof. It should be appreciated that such aspects also include, but are not limited to, the following:

(1) at least one additional chance in either the primary game or the bonus game associated with the gaming machine, such as free spins in a reel game, additional selections in a selection game, or free cards or draws in a poker game;

(2) at least one additional chance to win an award, such as a mystery award, which may or may not be associated with, or dependent on, either the primary game or the bonus game associated with the gaming machine;

(3) an increased frequency of awards for either the primary game or the bonus game associated with the gaming machine;

(4) an increased size of awards for either the primary game or the bonus game associated with the gaming machine;

(5) at least one advantage or additional feature in either the primary game or bonus game associated with the gaming machine, such as providing an additional pick or a hint in a selection game, or by reducing a threshold for a player to qualify for a certain game round or game award (i.e., the top level progressive award in a multi-level progressive game);

(6) at least one additional symbol or symbol combination (e.g., physical or virtual) in either the primary game or the bonus game associated with the gaming machine;

(7) at least one additional winning outcome for either the primary game or the bonus game associated with the gaming machine;

(8) at least one changed pay value associated with at least one of the symbols or symbol combinations in either the primary game or the bonus game associated with the gaming machine;

(9) a different or modified primary game or bonus game associated with the gaming machine, wherein such different primary game includes a different theme, different symbols, a different volatility, or a different paytable as the original primary game;

(10) a display caused by a controller or server, wherein such display by a service window associated with the server causes a notification to the player of a changed payback percentage (or hold percentage) associated with either the primary game or the bonus game associated with the gaming machine;

(11) at least one symbol overlay, such as a double symbol or a changed symbol for either the primary game or the bonus game associated with the gaming machine;

(12) enabling one or more progressive awards associated with either the primary game or the bonus game associated with the gaming machine; and

(13) an increment rate of one or more progressive awards associated with either the primary game or the bonus game associated with the gaming machine.

The disclosed gaming system and method encompasses changing the game and/or changing any one or more aspects of the game to provide a variable average expected payback percentage (or a variable average expected hold percentage) for the gaming machine being played by the player. Each aspect of the game could be changed, singularly or in combination with another aspect to achieve the desired average expected payback percentage (or average expected hold percentage). In one embodiment, the disclosed gaming system and method encompasses equalized bonus modes and events based on player selection and identification.

Two examples of how the disclosed gaming system and method can implement the variable average expected payback percentage (or the variable average expected hold percentage) are described herein as changing a paytable of a game associated with a gaming device and changing an award sequence of a game associated with a gaming device. The disclosed embodiments of the gaming system and method described below also encompass the examples of the variable average expected payback percentage (or the variable average expected hold percentage) described above. Such examples are not meant to limit the disclosed gaming system and method in any way.

For instance, changing the paytable of a game associated with a gaming device can include changing a displayed paytable of the game associated with the gaming device, or alternatively, can include changing a mapping associated with the paytable of the game associated with the gaming device. In either instance, changing the paytable is one example how the disclosed gaming system and method implement the variable average expected payback percentage (or the variable average expected hold percentage) disclosed below. Another example how the disclosed gaming system and method implement the variable average expected payback percentage (or the variable average expected hold percentage) is by changing an award sequence of the game associated with the gaming device.

In one embodiment, the gaming system disclosed herein includes a central server, central controller or remote host in communication with or linked to a plurality of gaming machines or gaming devices. To change the game being played by the player and/or one or more aspects thereof, the central controller of the gaming system communicates with the gaming machine through appropriate messaging. The central controller exchanges messages or signals with the gaming machine regarding the player's status or ranking, the default average expected payback percentage of the game being played by the player, and whether the game being played by the player and/or at least one aspect thereof, if any, will be changed based on the player's status or ranking.

In one embodiment, the gaming system provides different paytables having different average expected returns to the player. The different average expected returns represent different average expected payback percentages (or different average expected hold percentages) for the gaming machine being played by the player. The gaming system associates different paytables having different average expected returns with different player identifications, statuses or rankings. The gaming system can change the average expected return for a game being played by the player based on that player's identification, status or ranking. This creates a new impression for the same game being played by the player.

In another embodiment, the gaming system changes the average expected payback percentage (or the average expected hold percentage) of the gaming machine being played by the player with one or more different award sequences. That is, the gaming system changes the average expected return to the player with the one or more different award sequences. In this embodiment, the gaming system can communicate the one or more different award sequences to the gaming machine being played by the player. Based on the player's status or ranking, the gaming system determines whether to change the average expected payback percentage (or the average expected hold percentage) of the gaming machine being played by the player. If the gaming system determines to change the average expected payback percentage (or the average expected hold percentage) of the gaming machine being played by the player, the gaming system communicates an award sequence having a different average expected payback percentage (or having a different average expected hold percentage) to that gaming machine. This enables the gaming system to change the average expected payback percentage (or the average expected hold percentage) of that gaming machine based on the player's status or ranking. In one embodiment, the different award sequence includes a new game with a different average expected payback percentage, which increases the excitement and entertainment level of the player.

Providing a player an award sequence based on a player's status or ranking provides a unique and powerful tool for providing loyalty incentives to players. That is, when a player starts a gaming session, the player's ranking is communicated from the player's gaming device or the player tracking system to a central controller and the award sequence based on that player's individual ranking is communicated from the central controller to the player's gaming device. The communicated award sequence is provided to the player at the player's gaming device during game play. Such a configuration enables the gaming system to provide the player an award sequence based on the player's ranking immediately and at the gaming device the player is currently playing. Accordingly, the gaming system disclosed herein provides the player with one or more award sequences having a designated average expected payback as part of the player's gaming experience.

In one embodiment, the gaming system is in communication with one or more player tracking or player loyalty systems to identify one or more players currently playing at one or more of the gaming devices in the gaming system in a conventional manner. The player tracking system includes the player's account number, the player's card number, the player's first name, the player's surname, the player's preferred name, the player's player tracking ranking, any player tracking points associated with the player's player tracking card, any promotion status associated with the player's player tracking card, the player's address, the player's birthday, the player's anniversary, the player's recent gaming sessions and game activity, or any other suitable data. It should be appreciated that the player's gaming device and/or the player tracking system can use any such data to identify and rank the player.

In one embodiment, the gaming system includes a plurality of paytables with each paytable having a different average expected payback. One of the paytables is designated as an initial or default paytable having an initial or default average expected payback. The other paytables are designated as adjusted or modified paytables having adjusted (e.g., increased) average expected paybacks. The central controller determines whether to provide the initial paytable or one of the adjusted paytables to one or more players at the gaming devices in the gaming system. In one such embodiment, the central controller utilizes information or data communicated from the player tracking system to determine which paytable(s) to provide certain player(s). In this embodiment, the central controller is adapted to target specific players or groups of players based on each individual player's player ranking, wherein the player ranking is based on the individual player's gaming activity, such as the player's amount wagered, time played, games won or player tracking status.

If the central controller determines to provide a player an adjusted paytable, in one embodiment, the central controller determines an amount or value to increase the average expected payback from the initial or default average expected payback. As described below, this determined amount or value may or may not actually be provided to the player during game play. In one embodiment, the value (or expected value) for the determined paytable is determined based on the player's ranking or status (such as determined through a player tracking system), wherein the greater the player's ranking or status, the greater the value (or expected value) for the adjusted paytable for that player. It should be appreciated that the value (or expected value) for the paytable is determined in any suitable manner.

In one embodiment, after determining an amount or value to increase the average expected payback from the initial or default average expected payback, the central controller determines an appropriate award sequence and communicates the determined award sequence to the player's gaming device. In an alternative embodiment, the central controller communicates suitable instructions or commands to the gaming device to implement the determined award sequence stored by the gaming device. As described below, the player's gaming device utilizes the determined award sequence to provide a designated average expected payback to the player based on the determined amount or value. In this embodiment, the central controller determines the award sequence based on the player's specific wagering activity, the player's specific ranking or the player's specific status (as determined by the player tracking system). In determining an appropriate award sequence, the central controller must account for the specific game played by the player, including the average expected payout of each game played.

It should be appreciated that the average expected payback percentage and the average expected hold percentage theoretically (i.e., on average) constitute 100% of any money wagered in the gaming system. In the described embodiments, the average expected payback percentage is adjusted based on the player's status or ranking. It should also be appreciated that this could be looked at in another way. For example, the gaming system can adjust an average expected hold percentage of the gaming device being played by the player based on the player's status or ranking. This may be in the form of a rebate off the average expected hold percentage. Since the average expected hold percentage and the average expected payback percentage of the gaming device constitute on average 100% of the money wagered on the gaming device, changing the average expected payback percentage will also change the average expected hold percentage. Accordingly, as the average expected payback percentage increases, the average expected hold percentage decreases, and vice versa. For example, the gaming system, on average, will hold a lower amount of the total money wagered by a player with a high ranking (e.g., a gold ranking) than of the total money wagered by a player with a low ranking (e.g., a bronze ranking). By holding a lower amount, on average, the gaming system will effectively payback a higher amount to higher ranked players.

Accordingly, the gaming system and method disclosed herein provides a gaming establishment operator maximum flexibility in offering loyalty incentives to the player while providing the players with an award sequence that is useful to them and immediately gratifying. Such a gaming system further provides the gaming establishment operator an alternative means to provide incentives to players without requiring all of the associated costs of mailings and announcements. These savings can be returned back to the players to further increase their loyalty to the gaming establishment.

The variable average expected payback (or hold) percentages disclosed herein enhance the overall gaming experience for a player. In one embodiment, the gaming system and method disclosed herein includes equalized bonus modes or events, which are based on player selection and recognition, to effect such variable average expected payback (or hold) percentages.

Additional features and advantages of the disclosed embodiments are described in, and will be apparent from, the following Detailed Description and the Figures.

BRIEF DESCRIPTION OF THE DRAWINGS

FIGS. 5A, 5B, 5C, and 5D are schematic views of four example paytables of one embodiment of the present disclosure, wherein each paytable is associated with a different average expected payback.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
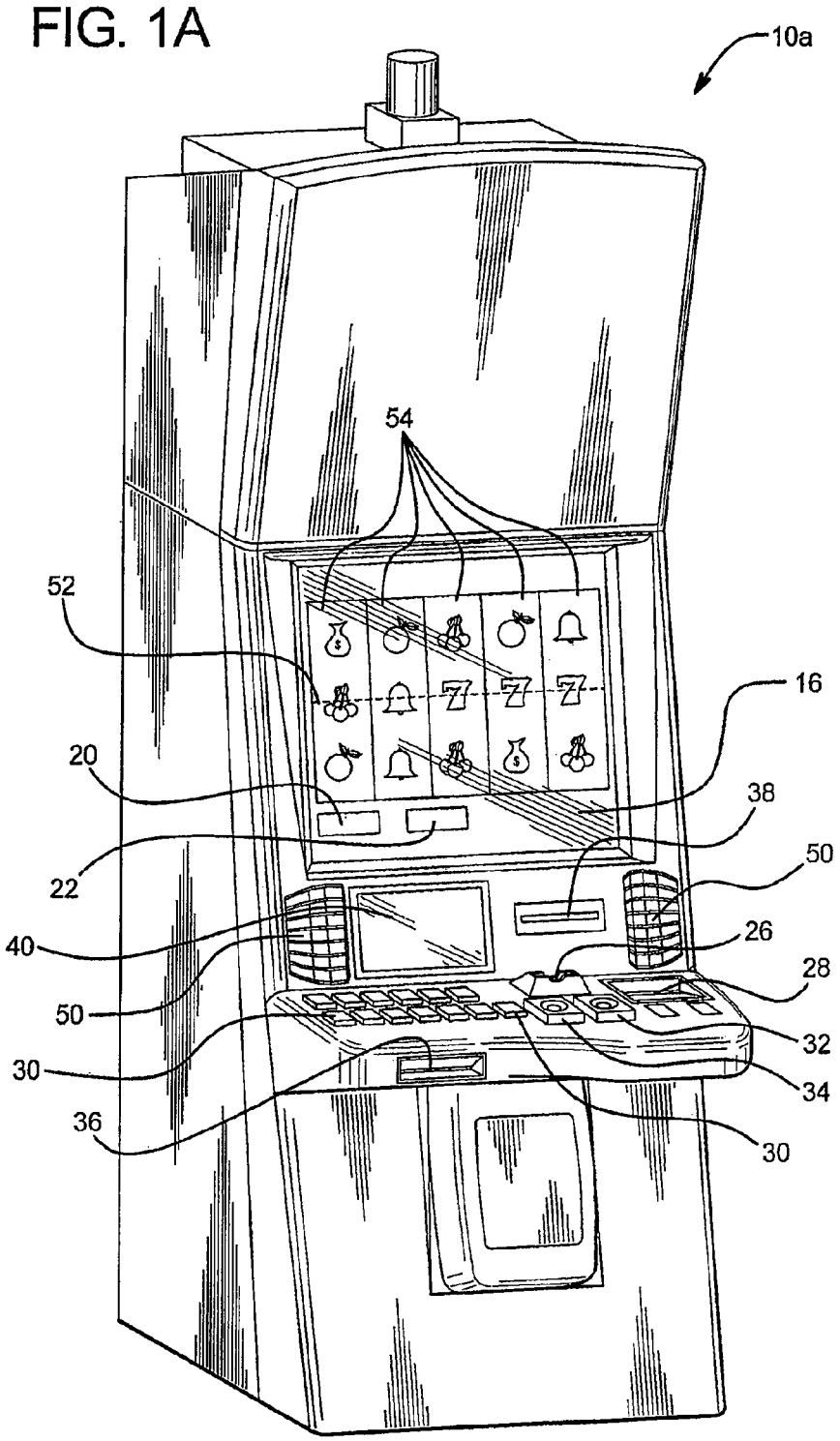
FIGS. 1A and 1B are perspective views of example alternative embodiments of the gaming device of the present disclosure.
Figure 1B:
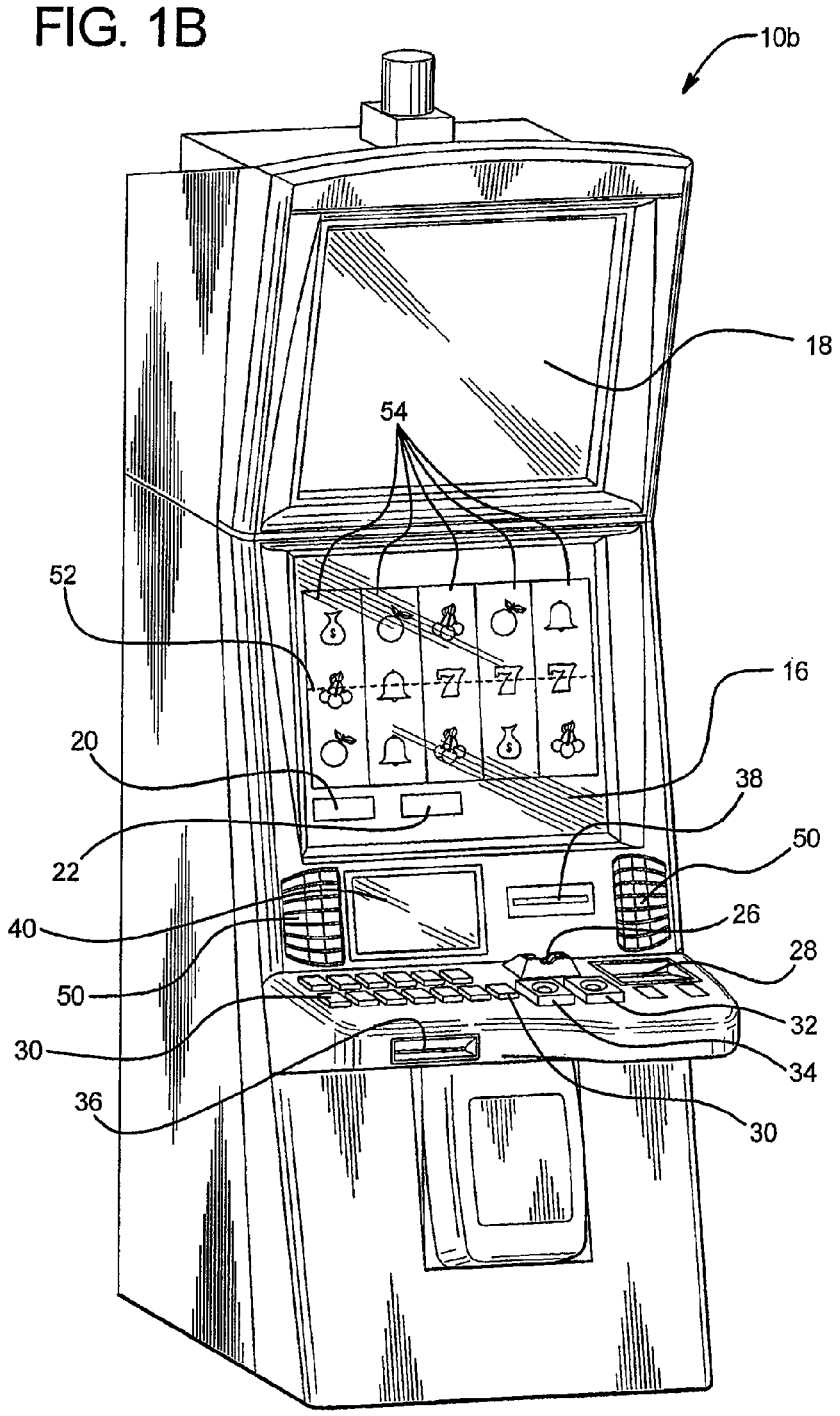

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
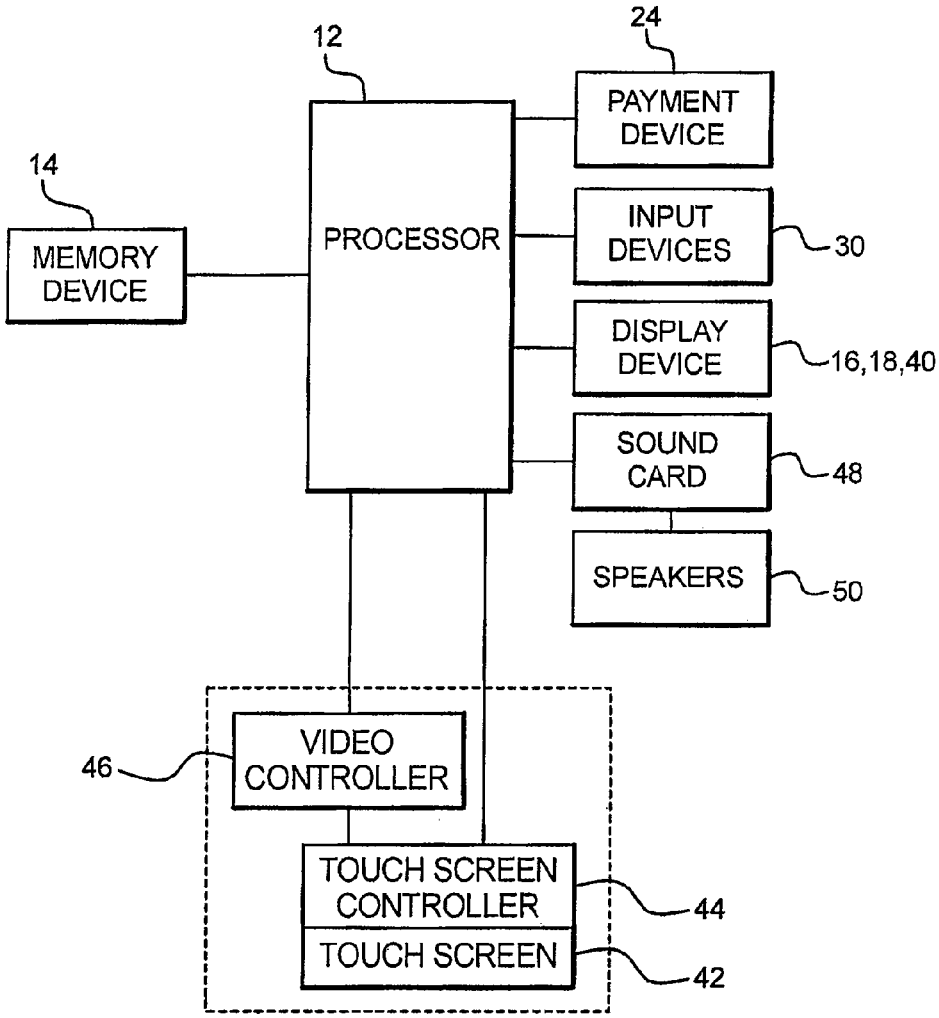
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
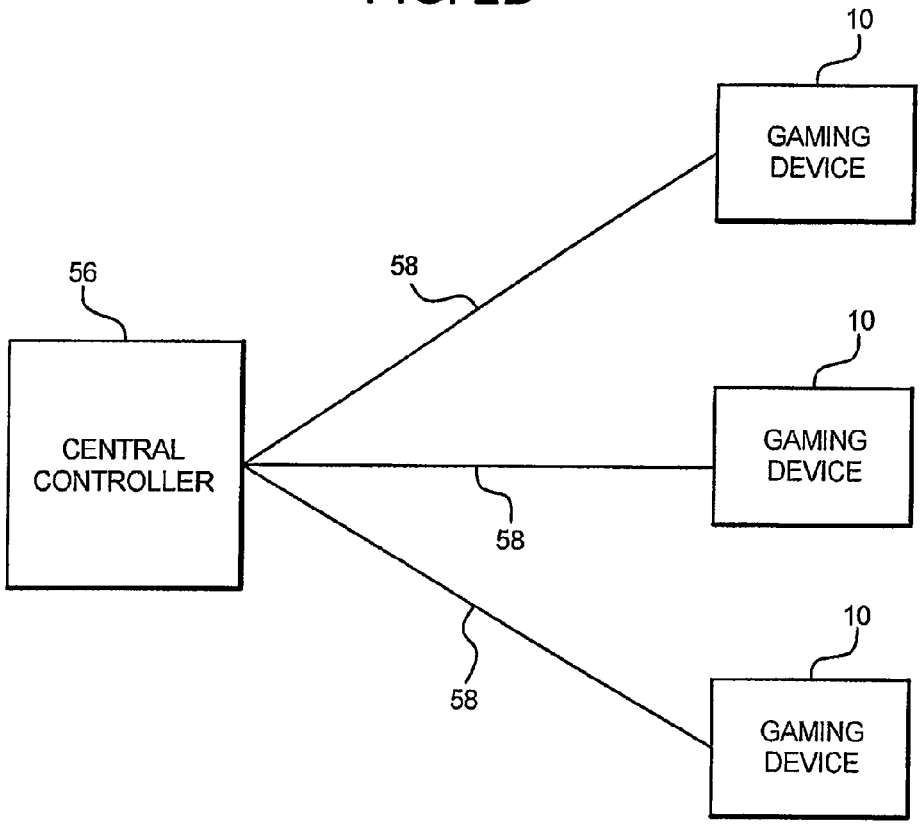
FIG. 2B is a schematic block diagram of one embodiment of a gaming system network configuration including a plurality of gaming devices disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In this embodiment, the gaming device and/or player tracking system identifies any players and tracks the gaming activity of those players at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag, or any other suitable wireless device to identify a player and track when the player begins and ends a gaming session. In another embodiment, the gaming device utilizes any suitable biometric technology or ticket technology to identify a player and track when the player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any player tracking points associated with the player's player tracking card, any promotion status associated with the player's player tracking card, the player's address, the player's birthday, the player's anniversary, the player's recent gaming sessions and game activity, or any other suitable data. It should be appreciated that the gaming device and/or the player tracking system can use any such data to identify and rank the player. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

Additionally, the player ranking can also be based on one or more of the following: a total amount wagered by each player, a number of primary games played by each player, a number of secondary games played by each player, an amount of each wager placed on each play by each player, wherein the play is of a primary or secondary game, an amount of time between each play of each game by each player, and a quality of play of each player (i.e., a player's skill level or how closely each player plays to optimal play).

In one embodiment, the player's ranking begins to decrease or becomes void after a designated time period, such as a designated period of inactivity. In one such embodiment, the player may be required to play a certain number of games or wager a certain number of credits in a designated time period to remain actively ranked.

Variable Payback Percentages

The present disclosure provides a gaming system, a gaming device and a method for providing variable payout amounts in a primary or base game, a secondary or bonus game, or both. The variable payout amounts enable the gaming system or the gaming device to provide different average expected payouts to designated players. The designation is based on individual player rankings or player statuses as determined by the player tracking system and/or the gaming device.

The present disclosure provides a gaming system, a gaming device and a method for providing variable payout amounts in a primary or base game, a secondary or bonus game, or both. The variable payout amounts enable the gaming system or the gaming device to provide different average expected payouts to designated players. In one embodiment, the designation is based on individual player rankings or player statuses as determined by the player tracking system and/or the gaming device.

In one embodiment, the individual player rankings or player statuses are determined by the gaming device operator, a casino or gaming establishment. In different embodiments, the individual player rankings or player statuses are determined based on: (1) an amount of games played by at least one player, (2) a designated rate or speed at which an amount of games are played by at least one player, (3) time, (4) an amount of games played by at least one player in a designated amount of time, (5) any suitable criteria or statistic tracked for at least one player by the player tracking system, (6) which game or gaming devices have been played by at least one player, (7) an amount of credits or money won by at least one player, (8) an amount of credits or money lost by at least one player, (9) a number of visits to one or more designated gaming establishments or casinos, (10) an amount of purchases made within or at one or more designated gaming establishments or casinos, or (11) any combination of the above.

Figure 3:
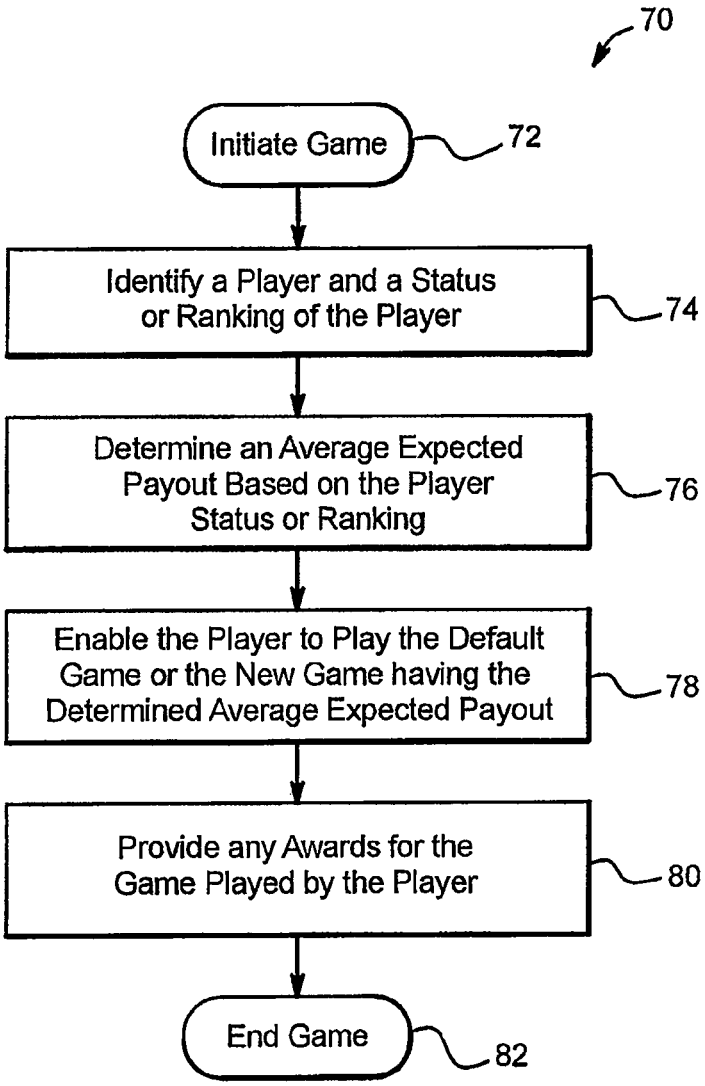
FIG. 3 is a process flow diagram showing one possible flow sequence of one embodiment of the present disclosure.

Referring now to FIG. 3, a flowchart of an example process 70 for providing a variable average expected payout in a gaming system or gaming device is illustrated. In one embodiment, the process 70 is embodied in one or more software programs stored in one or more memories and executed by one or more processors or controllers. Although the process 70 is described with reference to the flowchart illustrated in FIG. 3, it should be appreciated that many other methods of performing the acts associated with process 70 may be used. For example, the order of many of the blocks may be changed, and many of the blocks described may be optional.

The process 70 begins as indicated by block 72. In one embodiment, the process 70 begins when a player places a primary wager for a primary game of the gaming device 10. After receiving the money deposited by the player, the player is identified as indicated by block 74. The gaming system and/or the gaming device identifies the player via a player tracking system or a player loyalty system. In certain embodiments, a player begins a gaming session by inserting a playing tracking card, providing a pin code, or identifying himself or herself in any other suitable manner. In one embodiment, the player identification includes a player status or ranking based on the player's gaming activity. The gaming system, the gaming device and/or the player tracking system tracks the player's gaming activity at the gaming device and continuously, or periodically, updates the player's status or ranking information in association with the tracked gaming activity. In one embodiment, the player tracking system tracks the player's gaming activity along with the player's individual status or ranking. The player tracking system communicates information or messages indicating the player's individual status or ranking to the gaming system and/or the gaming device.

Based on the player's individual status or ranking, the gaming system and/or the gaming device determines an average expected payout for the identified player as indicated by block 76. In one embodiment, the average expected payout is based on the individual player's status or ranking. For example, the gaming system and/or the gaming device enables players of different statuses or rankings to play for different average expected payouts. In one such instance, uncarded or unidentifiable players play a default or original game having a default average expected payout of 90%. Bronze players (i.e., those players with a bronze status or ranking) play a game having an average expected payout of 92%. Silver players (i.e., those players with a silver status or ranking) play a game having an average expected payout of 93%. Gold players (i.e., those players with a gold status or ranking) play a game having an average expected payout of 95%. In one embodiment, the gaming device communicates a message or signal which indicates the default average expected payout, paytable information, such as symbols and awards, and any other suitable information regarding the default game to the central controller of the gaming system.

Once the gaming system and/or the gaming device determines the average expected payout for the identified player, the gaming system and/or the gaming device change the average expected payout of the default game in different ways depending upon the embodiment. For example, in one embodiment, the gaming system and/or the gaming device change the average expected payout by changing the default or original game being played by the player. In one such instance, the gaming system and/or the gaming device change the default or original to a new or different game having a higher average expected payout. In another embodiment, the gaming system and/or the gaming device change the average expected payout by changing one or more aspects of the default or original game being played by the player. Such aspects include, but are not limited to, (1) at least one displayed paytable associated with the game being played by the player, (2) at least one mapping of a paytable associated with the game being played by the player, (3) at least one award sequence associated with the game, (4) an eligibility to play the game, (5) at least one additional chance in either the primary game or the bonus game associated with the gaming machine, such as free spins in a reel game, additional selections in a selection game, or free cards or draws in a poker game, (6) at least one additional chance to win an award, such as a mystery award, which may or may not be associated with, or dependent on, either the primary game or the bonus game associated with the gaming machine, (7) an increased frequency of awards for either the primary game or the bonus game associated with the gaming machine, (8) an increased size of awards for either the primary game or the bonus game associated with the gaming machine, (9) at least one advantage or additional feature in either the primary game or bonus game associated with the gaming machine, such as providing an additional pick or a hint in a selection game, or by reducing a threshold for a player to qualify for a certain game round or game award (i.e., the top level progressive award in a multi-level progressive game), (10) at least one additional symbol or symbol combination (e.g., physical or virtual) in either the primary game or the bonus game associated with the gaming machine, (11) at least one additional winning outcome for either the primary game or the bonus game associated with the gaming machine, (12) at least one changed pay value associated with at least one of the symbols or symbol combinations in either the primary game or the bonus game associated with the gaming machine, (13) a different or modified primary game or bonus game associated with the gaming machine, wherein such different primary game includes a different theme, different symbols, a different volatility, or a different paytable as the original primary game, (14) a display caused by a controller or server, wherein such display by a service window associated with the server causes a notification to the player of a changed payback percentage (or hold percentage) associated with either the primary game or the bonus game associated with the gaming machine, (15) at least one symbol overlay, such as a double symbol or a changed symbol for either the primary game or the bonus game associated with the gaming machine, (16) enabling one or more progressive awards associated with either the primary game or the bonus game associated with the gaming machine, (17) an increment rate of one or more progressive awards associated with either the primary game or the bonus game associated with the gaming machine, and (18) any combination thereof.

For example, the gaming system and/or the gaming device change the symbols and/or the awards of the default or original game so that the default or original game has a higher average expected payout. In another embodiment, the gaming system and/or the gaming device change the average expected payout by changing the default or original game being played by the player and at least one aspect of the game. In one such instance, the gaming system and/or the gaming device change the default or original game to a new or different game with different eligibility requirements and a higher average expected payout than the default or original game.

In such embodiments, the central controller of the gaming system communicates instructions or signals to the gaming device through appropriate messaging in order to change the game played by the player at the gaming device and/or to change one or more aspects of the game as described above. The central controller exchanges messages or signals with the gaming machine regarding the player's status or ranking, an average expected payout of the game being played by the player, and whether the game or at least one aspect of the game, if any, will be changed based on the player's status or ranking.

In one embodiment, the central controller of the gaming system sends a message or signal to the gaming device to effect the change in average expected payout, if any. As described above, the message or signal can include (i) a new or different game with a higher average expected payout than the default game, (ii) at least one new or different aspect for the default game that increases the average expected payout of the default game, or (iii) a new or different game with a higher average expected payout than the default game and that incorporates at least one new or different aspect than the default game. That is, the central controller of the gaming system is configured to change the average expected payout or payback based on the player's status or ranking by communicating a new game, a different aspect for the default game or a new game having a different aspect than the default game to the gaming device.

Once the gaming device receives such message or signal from the central controller of the gaming system, the gaming device is configured to enable the player to play the default or original game or a new game having the determined average expected payout as indicated by block 78. In one embodiment, the central controller of the gaming system causes the gaming device to provide the default or original game or a new game with the determined average expected payout to the player.

As indicated by block 80, the gaming system and/or the gaming device provides any awards obtained during the game to the player. Such awards are based on and in association with the average expected payout determined as indicated by block 76. That is, an uncarded or unidentifiable player will on average win awards totaling 90% of the amount wagered by that player while bronze, silver and gold players will on average win awards totaling 92%, 93% and 95% of the amount wagered by that player, respectively. After the gaming system and/or the gaming device provides the awards, if any, to the player, the game ends as indicated by block 82.

Figure 4:
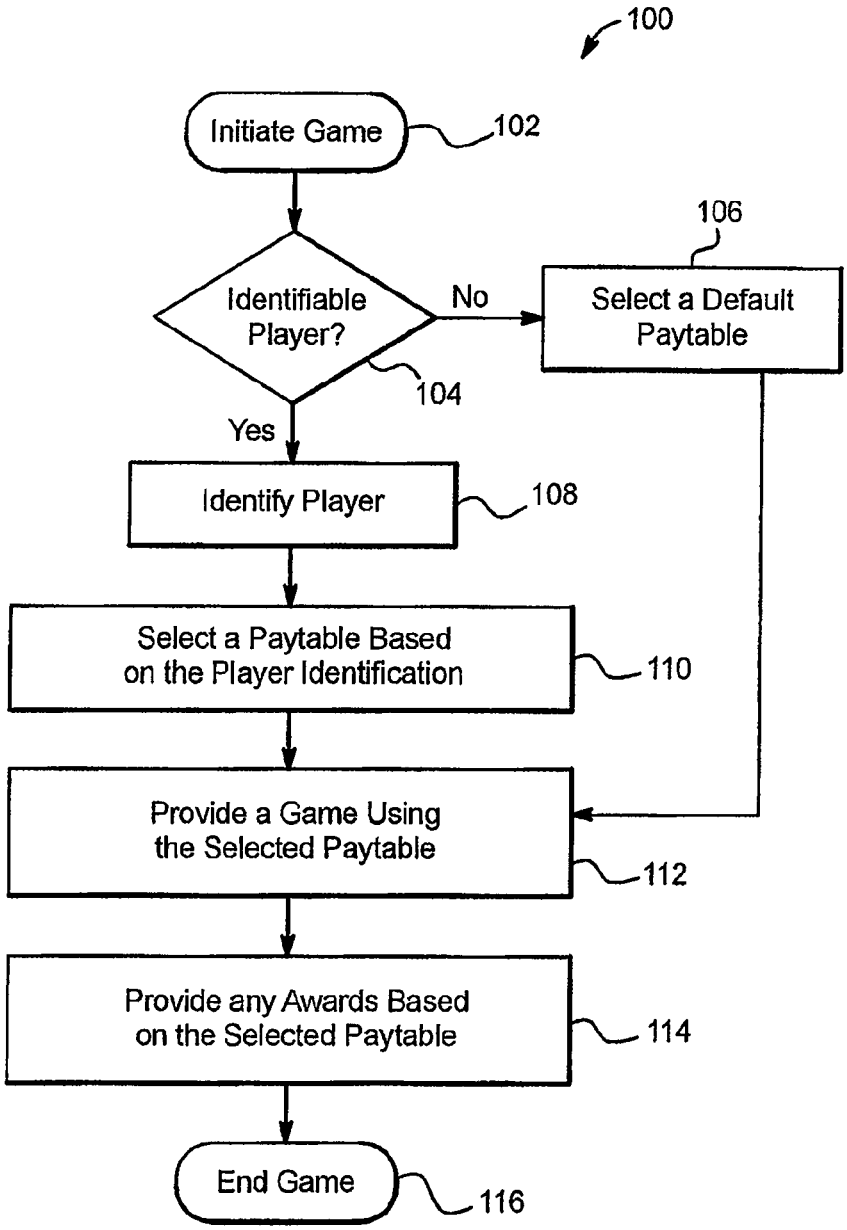
FIG. 4 is a process flow diagram showing one possible flow sequence of one embodiment of the present disclosure.

Referring now to the embodiment illustrated in FIG. 4, the variable payout amounts are implemented through different paytables having different average expected paybacks or payouts. In one such embodiment, the gaming system employs an initial one of the paytables and enables the player to qualify for a different paytable with a higher average expected payback based on an individual ranking associated with the player. If the player qualifies for a different paytable, the gaming system determines a game outcome for each play of the game and provides any awards based on the different paytable. If the player does not qualify for a different paytable, the gaming device determines any awards for those plays based on the initial paytable.

In the embodiment illustrated in FIG. 4, the gaming system and/or the gaming device operate according to sequence 100. In one embodiment, the process 100 is embodied in one or more software programs stored in one or more memories and executed by one or more processors or controllers. Although the process 100 is described with reference to the flowchart illustrated in FIG. 4, it should be appreciated that many other methods of performing the acts associated with process 100 may be used. For example, the order of many of the blocks may be changed, and many of the blocks described may be optional.

In one embodiment, a gaming device in the gaming system includes an initial or default paytable having an initial or a default average expected payback and one or more adjusted paytables having an adjusted (e.g., increased) average expected payback. The gaming device selects either the initial paytable or one of the adjusted paytables based on the player's ranking or status (as determined by a suitable player tracking or player loyalty system).

In one embodiment, the paytables are stored by a gaming device in the gaming system and the gaming device retrieves a selected one of the stored paytables based on the player's ranking or status. In another embodiment, the gaming device is in communication with a central server or central controller that maintains or stores a plurality of game instructions. In this embodiment, the central controller communicates the appropriate data or instructions for the gaming device to select one of the paytables to employ in the game. In another embodiment, the gaming device is in communication with another gaming device (e.g., a peer-to-peer network gaming environment) that maintains or stores a plurality of game instructions. In this embodiment, the other gaming device communicates the appropriate data or instructions for the gaming device to select one of the paytables to employ in the game. Upon receiving the data or instructions from the central controller, the gaming device provides the game in association with the selected paytable.

As indicated by block 102, the gaming device enables the player to deposit an amount of money into the gaming device to initiate a gaming session. In one embodiment, when a player deposits money, the gaming device displays the amount on a credit meter or other suitable display. After receiving the money deposited by the player, the gaming device determines whether the player is identifiable via a player tracking system or a player loyalty system, as indicated by block 104.

In certain embodiments, a player begins a gaming session by inserting a playing tracking card, providing a pin code, or identifying himself or herself in any other suitable manner. The gaming device tracks the player's gaming activity at the gaming device and continuously updates the player's identification and ranking information in association with the tracked gaming activity.

In one embodiment, if a player is unidentifiable, the gaming device selects the initial paytable for the game, as indicated by block 106. Unidentifiable players include uncarded players and unranked players. If the player is identifiable, as indicated by block 108, the gaming device identifies the player in association with the player tracking or player loyalty system. In one such embodiment, the player tracking or player loyalty system communicates the player identification and ranking information associated with the player to the gaming device. In another embodiment, the player tracking or player loyalty system communicates the player identification and ranking information associated with the player to the central server, which communicates the player identification and ranking information to the gaming device. In either embodiment, the gaming device receives the player identification and ranking information directly or indirectly from the player tracking or player loyalty system.

As indicated by block 110, the gaming device selects a paytable based on the player identification and ranking information. In one embodiment, the gaming device enables different players with different player identification and ranking information to be eligible for different paytables with different average expected paybacks. In one such embodiment, eligibility for certain paytables is determined through the player tracking system. In this embodiment, different adjusted paytables are associated with different player rankings. For example, a player with a first player ranking (e.g., no ranking) qualifies for the initial paytable having a first average expected payback (e.g., 90%). A player with a second higher ranking (e.g., bronze) qualifies for an adjusted paytable having a second average expected payback (e.g., 92%). A player with a third higher ranking (e.g., silver) qualifies for an adjusted paytable having a third average expected payback (e.g., 93%). A player with a fourth higher ranking (e.g., gold) qualifies for an adjusted paytable having a fourth average expected payback (e.g., 95%).

In one embodiment, upgrading to a different player ranking or player status requires a certain number of player tracking points. In one such embodiment, the casino or game operator determines the number of points required to upgrade to a different ranking or status. For example, one thousand player tracking points may be required for an unranked player to achieve a bronze ranking or status and two thousand player tracking points may be required for a bronze ranked player to achieve a silver ranking or status. In one embodiment, the casino or gaming establishment determines how many points are earned, and how many points are required to upgrade to a different ranking.

In one embodiment, the gaming system and/or the player tracking system enables the player to pay a fee to upgrade to a different ranking or status. For example, five thousand player tracking points may be required for a player to achieve a silver ranking or status. If the player has four thousand player tracking points, the gaming system and/or the player tracking system charges the player a fee for the one thousand player tracking points needed to upgrade to the silver status or ranking. If the player pays the fee, the player's point total increases to five thousand player tracking points, which is enough to upgrade that player to the silver ranking or status.

It should be appreciated that the gaming system and/or the player tracking system can charge the fee to the player as a monetary value or as an amount of player tracking points. The fee can vary based on either the player's player tracking points and/or the player's status or ranking.

In one embodiment, the fee is a designated monetary value, such as one penny, one nickel or one dollar, for each player tracking point needed to upgrade the player to a different player status or ranking. In one such instance, the fee is $0.01 for each player tracking point and the gaming system and/or the player tracking system charges the player a fee of $10.00 for the one thousand player tracking points needed for the silver status or ranking. In another embodiment, the fee is a designated monetary value, such as one penny, one dollar or ten dollars, associated with each player status or ranking. For example, an unranked player may be required to pay $5.00 to achieve a bronze status or ranking for a predetermined period of time (e.g., ten minutes) or for the identified player's gaming session. A bronze player may be required to pay $10.00 to achieve a silver status or ranking for a predetermined period of time (e.g., fifteen minutes) or for the identified player's gaming session. In this example, the increased status or ranking is maintained for a longer time limit. For example, the ranking fee is ten dollars for a bronze player to upgrade to the silver status or ranking for fifteen minutes, whereas an unranked player upgrades to the bronze status or ranking for a shorter time, e.g., ten minutes.

In one embodiment, the gaming system and/or the player tracking system may require players to progress to each status or ranking. In one such instance, unranked players are required to pay a fee to upgrade to the bronze status or ranking and required to pay a fee to upgrade from the bronze status or ranking to the silver status or ranking. In this example, unranked players effectively pay $15.00 to upgrade to the silver status or ranking. Alternatively, unranked players are not required to pay for the bronze status or ranking and effectively pay $10.00 to upgrade to the silver status or ranking.

In another embodiment, the gaming system and/or the player tracking system charges the fee to player in the form of player tracking points. That is, the gaming system and/or the player tracking system enables the player to trade in a designated number of player tracking points to upgrade to a different ranking or status. In one such instance, the gaming system may require or determine that ten thousand player tracking points are needed for a player to achieve an upgrade to a gold ranking or status. If the player has nine thousand player tracking points, the gaming system and/or the player tracking system enables the player to trade in one thousand player tracking points for the upgrade.

In one embodiment, if the player does not have player tracking points to trade in, the gaming system and/or the player tracking system borrows player tracking points to the player. For example, the gaming system may require or determine that ten thousand player tracking points are needed for a player to achieve an upgrade to a gold ranking or status. If the player has nine thousand player tracking points, the gaming system and/or the player tracking system enables the player to borrow one thousand player tracking points to increase the player's point total to ten thousand player tracking points. With the borrowed player tracking points, the player has enough player tracking points to upgrade to the gold ranking or status. In one embodiment, the upgrade to the gold ranking or status is effective for a predetermined period of time (e.g., twenty minutes) or for the identified player's gaming session.

In one embodiment, the gaming system and/or the player tracking system enables the player to borrow the player tracking points as an advance for future player tracking points. That is, the gaming system and/or the player tracking system tracks the next one thousand player tracking points earned by the player and applies such points to the one thousand borrowed player tracking points until the borrowed amount is repaid. In one embodiment, the gaming system and/or the player tracking system charges the player a fee for such advance. In another embodiment, the gaming system and/or the player tracking system charges the player an additional fee for borrowing player tracking points. The additional fee may be applied as a one-time fee or as interest charged to the player's player tracking account. For example, if the player borrows one thousand player tracking points with interest, one thousand two hundred player tracking points may be required to reconcile the player's debt.

Referring again to FIG. 4, after the gaming device selects the appropriate paytable based on the player identification and ranking information, the gaming device provides the game using the selected paytable, as indicated by block 112. If the player qualified for the initial or default paytable, the gaming device provides the game using the initial or default paytable as indicated by block 112. If the player qualified for one of the adjusted paytables, the gaming device provides the game using the selected adjusted paytable as indicated by block 112. In one embodiment, the gaming device keeps the same game but changes one aspect of the game, such as the paytable, one or more game symbols, or one or more awards, to provide the desired or designated average expected payback. Alternatively, the gaming device changes the game along with the paytable to provide the desired or designated average expected payback.

During play of the game, the gaming device determines a game outcome for the play of the game. As illustrated by block 114, the gaming device determines any awards associated with the determined game outcome based on the selected paytable and updates the credit meter to reflect credits won by the player, if any. As described above, the selected paytable has a designated average expected payback based on the player identification and ranking information. In one embodiment, players with higher rankings qualify for paytables with higher average expected paybacks.

It should be appreciated that the awards are adjustable in amount and triggering frequency to meet the level of the player's loyalty (i.e., the player's ranking). In one embodiment, frequent or loyal players (e.g., those players with a high ranking) are provided more frequent or larger awards than less frequent or loyal players (e.g., those players with a low ranking or no ranking). The amount and frequency of the awards contribute to the average expected payback of the selected paytable.

After determining whether the player wins any awards based on the selected paytable, the gaming device determines whether the player has any credits remaining. If the gaming device determines that the player has credits remaining, the gaming device enables the player to repeat sequence 100 beginning at block 102. Alternatively, the player may cash out any remaining credits and discontinue gaming, as indicated by block 116. If the gaming device determines that the player has no more credits remaining, the gaming device enables the player to deposit an additional amount of money into the gaming device to initiate a new gaming session and sequence 100 begins again starting at block 102.

In one embodiment, the player may continue playing with the selected paytable until the gaming session ends or until the credit meter reaches zero (i.e., there are no more credits remaining). In certain embodiments, the gaming session ends when an amount of time has elapsed, when the player has run out of a provided number of plays with the selected paytable, when the player has wagered a designated amount, or after any other suitable event. It should be appreciated that, at any time between plays of the game, the player may cash out any remaining credits and discontinue gaming, as indicated by block 116.

In certain embodiments, once the gaming device and/or the gaming system identifies a player's ranking via a player tracking card or any other suitable device, the gaming device enables the player to continue playing with the selected paytable until the player removes the player tracking card. In one embodiment, the selected paytable for the gaming device where the player is playing is associated with a different game, so that the player changes games while playing at the same gaming device. In one embodiment, if the player moves from one gaming device where the player was playing with a selected paytable to a different gaming device, the moved-to gaming device enables the player to continue playing with the selected paytable. Alternatively, if the player moves to a different gaming device, the player must still meet the qualifications for the selected paytable at the moved-to gaming device to play with the selected paytable at that gaming device. In one embodiment, the player's ranking or status expires after a designated amount of time, such as a period of inactivity.

In one embodiment, during play of the game, the player's identification and ranking information may change. In one such embodiment, play of the game causes the player's ranking to increase (e.g., from a bronze ranking to a silver ranking). In this case, the sequence 100 returns to block 110 and selects a new paytable based on the player's increased ranking. Subsequent game play and awards, as indicated by blocks 112 and 114, would be based on the newly selected paytable. It should be appreciated that such changes to the player's identification and ranking can be stored or delivered to the player tracking card or other suitable device used to identify and rank the player.

It should also be appreciated that various methods for giving the player a ranking advantage are contemplated. For instance, the gaming system can enable the players to place one or more side wagers or additional wagers to directly improve their player ranking. In one example, a side wager increases the ranking for at least one player or gaming machine by a predetermined amount of player tracking points, or by a random amount within a predetermined range of player tracking points. In another example, a side wager increases the ranking for at least one player to a predetermined or randomly determined higher ranking. Such ranking advantages give the player a greater chance to achieve a higher average expected payback, a greater award, a more frequent award, or some combination thereof.

Referring now to FIGS. 5A, 5B, 5C, and 5D, one example embodiment of the gaming device of the present disclosure offers a plurality of different paytables: an initial paytable labeled Paytable A 202*a* and three adjusted paytables labeled Paytable B 202*b*, Paytable C 202*c*, and Paytable D 202*d*. FIGS. 5A, 5B, 5C, and 5D show the expected win values for playing with the initial paytable 202*a* and the adjusted paytables 202*b*, 202*c*, and 202*d*. The values of the win amounts and the frequency thereof are determined based on the average expected payout associated with the paytable. It should be appreciated that the average expected payouts of the paytables can be adjusted as desired by the game operator.

Each paytable 202*a*, 202*b*, 202*c*, and 202*d* includes symbols or symbol combinations that produce respective awards for the player. The symbol combinations, their respective awards, and the chance of the symbol combinations occurring (not shown) of each of Paytable A 202*a*, Paytable B 202*b*, and Paytable C 202*c* determine the average expected payback for that paytable. It should be appreciated that for illustration purposes, FIGS. 5A, 5B, 5C and 5D display a sampling of the different symbol combinations (i.e., four symbol combinations) in Paytable A 202*a*, Paytable B 202*b*, Paytable C 202*c*, and Paytable D 202*d*. It should be appreciated that Paytable A 202*a*, Paytable B 202*b*, Paytable C 202*c*, and Paytable D 202*d* do not show losing or non-winning outcomes or other potential winning outcomes.

Each paytable has an average expected payback and a volatility. In one embodiment of the present disclosure, a plurality of the paytables have different average expected paybacks. For example, as shown in FIGS. 5A and 5B, the average expected payback for Paytable A 202*a* (90%) is different from the average expected payback for Paytable B 202*b* (92%). In FIGS. 5C and 5D, the average expected payback for Paytable C 202*c* (93%) is different from the average expected payback for Paytable D 202*d* (95%). As illustrated, each of the paytables has a different average expected payback.

In one embodiment, a plurality of the paytables have different volatilities. In another embodiment, each of the paytables has a different volatility. For example, as shown in FIGS. 5A, 5B, 5C, and 5D, Paytable C 202*c* has greater volatility than Paytable A 202*a*, Paytable B 202*b*, and Paytable D 202*d*. That is, the range of possible awards in Paytable C 202*c* is greater than the range of possible awards in Paytable A 202*a*, Paytable B 202*b* and Paytable D 202*d* (i.e., the awards in Paytable C 202*c* range between the lowest possible award of 100 and the highest possible award of 75,000). In another embodiment, a plurality of the paytables have the same volatility. In another embodiment, each of the paytables has the same volatility.

As illustrated in FIGS. 5A, 5B, 5C, and 5D, Paytable A 202*a*, Paytable B 202*b*, Paytable C 202*c*, and Paytable D 202*d* display symbols or symbol combinations that produce respective awards for the player. It should be appreciated that a paytable can have any number of winning symbols or winning symbol combinations. In one embodiment, a plurality of the paytables have the same number of winning symbols or symbol combinations. In another embodiment, a plurality of the paytables have a different number of winning symbols or symbol combinations. In one embodiment, a plurality of the paytables have the same type of winning symbols or symbol combinations. In another embodiment, a plurality of the paytables have different types of winning symbols or symbol combinations. In other embodiments, a plurality of the paytables have both different numbers of winning symbols or symbol combinations and different types of winning symbols or symbol combinations.

For example, a first paytable may have N symbols, where N is equal to 512, and a 90% average expected payback. A second paytable may include M symbols, where M is equal to 1024. The second paytable may have different symbols, the same symbols, or additional symbols as the first paytable. In one example, the second paytable includes a CAR symbol, which represents the prize of winning a car, and the first paytable does not include a CAR symbol. Thus, the second paytable has the CAR symbol, which does not exist on the first paytable, and the second paytable has more symbols than the first paytable (i.e., the second paytable has M, or 1024, symbols while the first paytable has N, or 512, symbols). The second paytable has a higher average expected payback (i.e., 92%) that includes the CAR symbol in the second paytable.

In another example, a first paytable and a second paytable each have the same number of symbols. The first paytable includes one CAR symbol and has an average expected payback of 90%. The second paytable includes two CAR symbols and has an average expected payback of 92%. The first paytable and the second paytable have the same number of symbols, but the higher frequency of the CAR symbol in the second paytable causes the second paytable to have a higher average expected payback than the first paytable.

In another example, a first paytable and a second paytable each have different mappings with respect to the symbols. The first paytable and the second paytable may or may not have the same number of symbols, or the same type of symbols. However, at least one mapping (i.e., the association of an award with at least one symbol or symbol combination) is different between the first and second paytables. That is, in one example, the first paytable and the second paytable are identical except for the symbol combination of 7-7-7. In the first paytable, the symbol combination of 7-7-7 is associated with, or mapped to, an award of 100 credits. In the second paytable, the symbol combination of 7-7-7 is associated with, or mapped to, an award of 150 credits. The different mappings of the first paytable and the second paytable cause the second paytable to have a higher average expected payback than the first paytable. The number of differences between the paytables can be any suitable number.

Referring back to FIG. 5A, the initial paytable 202*a* employed by the gaming device for each game played is illustrated. In one embodiment, uncarded players or otherwise unidentifiable players are provided with this paytable by default. For example, the average expected payback associated with this default paytable is 90%. In this example, uncarded or unidentifiable players will not realize the benefits of one of the adjusted paytables until the player achieves a designated player ranking or status (as determined by the player tracking system).

In the embodiment illustrated in FIG. 5B, Paytable B 202*b* is a first adjusted paytable employed by the gaming device for players having a first designated player ranking or status (e.g., a bronze ranking). The average expected payback associated with this adjusted paytable is 92%. The average expected payback of 92% is 2% greater than the default average expected payback for the default paytable 202*a*. That is, players having the first designated player ranking or status (e.g., a bronze ranking) realize a 2% greater average expected payback than uncarded or unidentifiable players.

In the embodiment illustrated in FIG. 5C, Paytable C 202*c* is a second adjusted paytable employed by the gaming device for players having a second designated player ranking or status (e.g., a silver ranking). The average expected payback associated with this adjusted paytable is 93%. The average expected payback of 93% is 3% greater than the default average expected payback for the default paytable 202*a*. This average expected payback is 1% greater than the average expected payback for Paytable B 202*b*. That is, players having the second designated player ranking or status (e.g., a silver ranking) realize a 3% greater average expected payback than uncarded or unidentifiable players and a 1% greater average expected payback than players having the first designated player ranking or status (e.g., a bronze ranking).

In the embodiment illustrated in FIG. 5D, Paytable D 202*d* is a third adjusted paytable employed by the gaming device for players having a third designated player ranking or status (e.g., a gold ranking). The average expected payback associated with this adjusted paytable is 95%. The average expected payback of 95% is 5% greater than the default average expected payback for the default paytable 202*a*. This average expected payback is 3% greater than the average expected payback for Paytable B 202*b* and is 2% greater than the average expected payback for Paytable C 202*c*. That is, players having the third designated player ranking or status (e.g., a gold ranking) realize: (i) a 5% greater average expected payback than uncarded or unidentifiable players, (ii) a 3% greater average expected payback than players having the first designated player ranking or status (e.g., a bronze ranking), and (iii) a 2% greater average expected payback than players having the second designated player ranking or status (e.g., a silver ranking).

It should be appreciated that the paytables described in reference to FIGS. 5A to 5D show increases to the same default average expected payback based on the individual player ranking. For example, if a default payback percentage is 90% as shown in the table below, the bronze player ranking increases the average expected payback of the default paytable by 2%, the silver player ranking increases the average expected payback of the default paytable by 3% and the gold player ranking increases the average expected payback of the default paytable by 5%. In another embodiment, the different player rankings are associated with the same default average expected payback and incrementally increase. In another embodiment, at least one of the different player rankings is associated with a different default average expected payback and increases by a different amount than the other different player rankings.

The above-described embodiments are illustrated with the following example table.

| Default Payback Percentage | Bronze Player Effective Payback Percentage | Silver Player Effective Payback Percentage | Gold Player Effective Payback Percentage |
|---|---|---|---|
| 90% | 90% + 2% = 92% | 90% + 3% = 93% | 90% + 5% = 95% |
| 93% | 93% + 1% = 94% | 93% + 2% = 95% | 93% + 3% = 96% |
| 90% | 90% + 1% = 91% | 90% + 2% = 92% | 92% + 2% = 94% |

Alternatively, the adjusted paytables based on the player's ranking increase from the default average expected payback as a multiplicative increase in payback of money wagered. As described above, unranked or uncarded players are provided with the default average expected payback. For example, the gaming device provides a bronze ranked player with awards worth an extra 1% multiplicative increase in payback of money wagered. In this example, the effective payback percentage is calculated by adding the payback of money wagered (e.g., 90%) to the multiplicative increase in payback of the money wagered (e.g., x % of 90), where x is the multiplicative increase based on the player's individual ranking. For a bronze ranked player, the effective payback percentage equals 90.9% (e.g., 90%+1% of 90=90.9%). For a silver ranked player, the gaming device provides the silver ranked player with awards worth an extra 2% multiplicative increase in payback of money wagered. For the silver ranked player, the effective payback percentage equals 91.8% (e.g., 90%+2% of 90=91.8%). For a gold ranked player, the gaming device provides the silver ranked player with awards worth an extra 3% multiplicative increase in payback of money wagered. For the gold ranked player, the effective payback percentage equals 92.7% (e.g., 90%+3% of 90=92.7%). In one embodiment, at least one of the different player rankings is associated with a different default average payout and a different multiplier than the other different player rankings.

The following example illustrates such multiplicative increases and multipliers applied to the default payback percentage.

| Default Payback Percentage | Bronze Player Effective Payback Percentage | Silver Player Effective Payback Percentage | Gold Player Effective Payback Percentage |
|---|---|---|---|
| 90% | 90 + (1% of 90) = 90.9% | 90 + (2% of 90) = 91.8% | 90 + (3% of 90) = 92.7% |
| 95% | 95 + (1% of 95) = 95.95% | 95 + (2% of 95) = 96.9% | 94 + (3% of 94) = 97.85% |

In another embodiment, different player rankings are associated with constant payback percentages regardless of the average expected payback of the game. For example, the gaming device provides uncarded or unidentifiable players with an effective payback of 90%, bronze ranked players with an effective payback of 92%, silver ranked players with an effective return of 95% and gold ranked players with an effective return of 97%. In such an embodiment, the gaming device provides rewards with an expected return that provide the incremental increase in payback percentage required to meet the effective payback percentages for each player ranking. To provide such awards, the gaming device must determine the payback percentage of the base game being played (or receive the payback percentage of the base game being played from the central server).

In one embodiment, if the default payback percentage of the base game is above the effective payback percentage associated with one of the player rankings, the gaming device adjusts the default payback percentage of the base game as necessary. For example, if the default payback percentage of the base game is 94%, and the bronze player ranking is associated with an effective payback of 92%, the gaming device and/or the central controller can adjust the default payback percentage of the base game to 90%. This enables the bronze player ranking to increase the effective payback percentage of the base game to 92%. In an alternative embodiment, the gaming device (a) determines which of: (i) the default payback percentage of the base game; and (ii) the effective payback percentage associated with one of the player rankings is greater, and (b) selects the greater of (i) and (ii) as the payback percentage for the base game.

In another embodiment, the default payback percentage of the base game is set to a maximum value, which is less than the lowest effective payback percentage associated with the player rankings. For example, the lowest player ranking is a bronze player ranking with an effective payback of 92%. In this embodiment, the default payback percentage of the base game is set to a maximum value that is less than 92% so that the gaming device does not need to adjust the default payback percentage of the base game being played. That is, in determining an appropriate default payback percentage to communicate to the player's gaming device, the central controller must account for the specific game played by the player, including the average expected payout of each game played.

Referring now generally to FIGS. 6A to 6D, an example of one embodiment of the present disclosure is illustrated where the gaming device provides a player with a game. In this example, the game includes a plurality of symbol generators represented by a plurality of reels 120. The display device 16 or 18 displays each reel 120 as a mechanical or video reel having a plurality of symbols 122. Any suitable number of symbols 122 may be employed by the implementer of the gaming device of the present disclosure. A payline indicator 124 is associated with each of the reels and indicates one of the symbols 122 on each reel 120 after the reels 120 have been activated in a spin. At least one award is associated with one or more of the symbols 122 or combinations of such symbols 122 indicated by the payline indicator 124. The awards may be any suitable award such as values, credits, free spins, free games, multipliers, progressive awards, additional game symbols or symbol combinations, award opportunities, incrementing values for other awards (e.g., progressive awards) or any other suitable award as desired by the game implementer.

In this example, the reels 120 are associated with a default paytable, such as paytable A 202*a* illustrated in FIG. 5A. The reels 120 are also associated with three adjusted paytables, such as paytable B 202*b*, paytable C 202*c*, and paytable D 202*d* illustrated in FIGS. 5B to 5D, respectively. The gaming device accesses one of the paytables 202*a*-202*d* for each play of the game (i.e., each spin of the reels 120) to determine the award amount, if any, to be provided to the players for symbols or symbol combinations indicated by the payline indicator 124. The paytable 202*a*-202*d* selected for each play of the game is determined based on a player status or a player ranking via a suitable player tracking system or module.

It should be appreciated that the game could start with, or otherwise be associated with, any suitable number of adjusted paytables with any suitable average payout percentages desired by the game implementer. The starting number of adjusted paytables or the average payout percentages for one or more of the adjusted paytables are determined based on the player's status or ranking (as determined via a player tracking system). For example, as illustrated in FIGS. 6A to 6D, the gaming device starts with one adjusted paytable for each player status or player ranking identified or tracked by the player tracking system. In this example, the player tracking system tracks three player statuses or rankings (i.e., bronze, silver, and gold). Thus, the gaming device starts with three adjusted paytables in this example. It should be appreciated that certain players, such as new players, uncarded players or unidentifiable players, could be tracked by the player tracking system but not recognized as a bronze, silver or gold status player. The gaming device 10 enables such players to play the game with the default paytable and default payout percentage.

In alternative embodiments, the starting number of paytables or the average payout percentages for one or more of the adjusted paytables are predetermined, randomly determined, determined based on the player's wager, determined based on a triggering event, determined based on time, or determined in any other suitable manner.

Figure 6A:
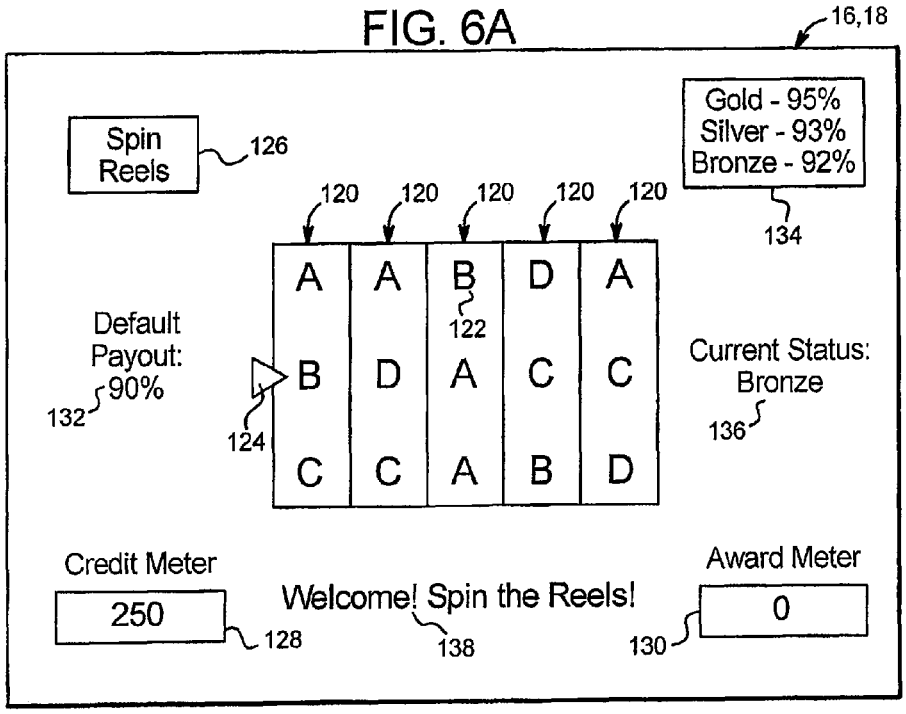
FIGS. 6A, 6B, 6C, and 6D are enlarged front plan views of a display device of the gaming device disclosed herein, illustrating an example of one embodiment of the present disclosure where the paytables of FIGS. 5A to 5D are available to certain players during a play of a game.

Referring now to FIG. 6A, display device 16 or 18 illustrates one example of a game play screen at the beginning of the game. For ease of illustration, each of the relevant apparatus is shown on the same display device 16 or 18. In alternative embodiments, different areas of the gaming device 10 display the relevant portions of the game.

The display device 16 or 18 displays the reels 120 to the player. Reels 120 display fifteen total symbols 122 with one symbol 122 of each reel 120 being associated with the payline indicator 124. For example, the payline indicator 124 indicates symbols "B", "D", "A", "C" and "C" on the reels 120.

The display device 16 or 18 provides a spin initiator display 126. The spin initiator display 126 indicates to the player when the reels 120 can be activated through any suitable illumination or highlighting. That is, when the spin initiator display 126 is illuminated or highlighted, the player can spin the reels 120 for that play of the game. In one embodiment, the spin initiator display 126 is a "SPIN REELS" button that causes the reels to spin after the player activates the button.

The display device 16 or 18 also provides a credit meter display 128. The credit meter display 128 displays a credit amount provided to the player. In this example, the player has inserted a credit amount of two-hundred fifty credits as illustrated in FIG. 6A. Each spin of the reels 120 represents a chance to change one or more symbols 122 associated with the payline indicator 124 of the gaming device 10. The credit amount displayed by the credit meter display 128 decreases by one or more credits for each spin of the reels 120. Thus, at any point in the game, the player knows how many credits remain for play of the game.

The display device 16 or 18 also provides an award meter display 130. The award meter display 130 indicates to the player how many credits or other type(s) of award are provided for playing the game. During a game, any reward received by the player is added to the award amount indicated by the award meter display 130. Once a game ends, the award amount indicated by the award meter display 130 is provided to the player. For example, the award amount indicated by the award meter display 130 is added to the credit amount indicated by the credit meter display 128. Because the player has not yet won an award, the award meter display 130 in FIG. 6A shows that the award amount is zero.

The display device 16 or 18 further provides a default payout display 132 and a potential payout display 134. The default payout display 132 indicates to the player the default effective payout percentage of the game. In the example illustrated in FIGS. 6A to 6D, the default payout percentage is 90%. The default payout percentage is associated with the default paytable 202*a* of FIG. 5A. The potential payout display 134 indicates to the player any adjusted payout percentages available for the game. The adjusted payout percentages are associated with the adjusted paytables 202*b*-202*d* of FIGS. 5B to 5D. In this example, the adjusted payout for a bronze status or ranking is 92%, the adjusted payout for a silver status or ranking is 93%, and the adjusted payout for a gold status or ranking is 95%. In one embodiment, the display device 16 or 18 displays the default and adjusted paytables 202*a*-202*d* illustrated in FIGS. 5A to 5D in association with the displayed default and adjusted payouts.

In different embodiments, the display device 16 or 18 displays various messages or information notifying the identified player how the identified player's ranking is helping that player during the game. For example, the display device 16 or 18 displays a contrast between an amount of credits or money won by a non-carded or unidentified player, and an amount of credits or money won by the carded or identified player. In this example, the display device could display a message stating "Non-carded Players Win 5 Credits, But Gold Players Win 50 Credits." It should be appreciated that the display device 16 or 18 can display other messages and information to notify the identified player how the player ranking is benefiting that player during the game. For instance, the display device 16 or 18 displays a quantity of free spins provided during the game because the identified player is a gold player, along with the amount of credits won by playing those free spins during the game.

The display device 16 or 18 also provides a current status or ranking display 136. The current status or ranking display 136 indicates to the player's current status or ranking as determined by the player tracking system or module. The player's current status or ranking indicated by the current display 136 determines which of the effective payout percentages, if any, that the player qualifies for that play of the game. As illustrated in FIG. 6A, the gaming device 10 initially starts with a default status indicated by the current display 136. The status indicated by the current display 136 changes from the default status based on the player's status or ranking. If the player is ranked or has a recognized player status, the current display 136 changes to reflect this ranking or status.

In one embodiment, the display device 16 or 18 also provides a message display area 138. The message display area 138 indicates appropriate messages, commands or any other suitable data or signal to the player in audio, visual or audio-visual formats. In the example illustrated in FIG. 5A, the message display area 138 indicates a welcome message to the player, such as "WELCOME! SPIN THE REELS!"

Figure 6B:
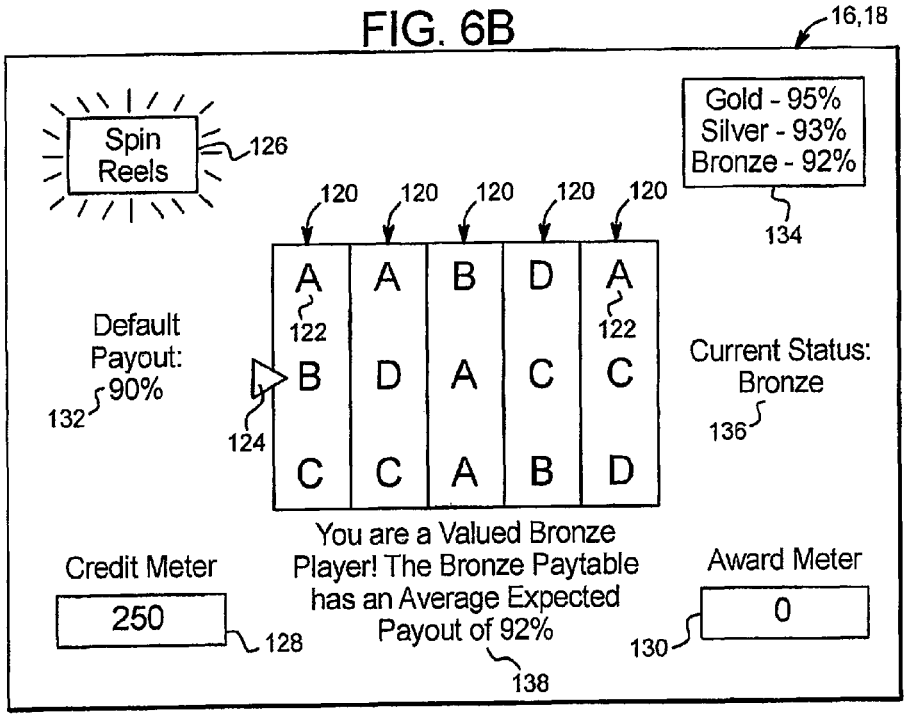

Referring now to FIG. 6B, the gaming device 10 prompts the player to spin the reels 120. In one embodiment, the spin initiator display 126 is illuminated or highlighted to prompt the player to spin the reels 120. As indicated by the current display 136, the player has a bronze status or ranking. As described above, the player's status or ranking can be determined through a suitable player tracking device or module. In the example illustrated in FIG. 6B, the player has inserted a player tracking card into the gaming device 10. The gaming device 10 reads the player tracking card and causes the current display 136 to indicate the player's status or ranking based on information read from the inserted player tracking card. Based on the player's bronze status or ranking, the gaming device 10 associates an adjusted paytable with a payout percentage adjusted for a bronze status or ranking with this play of the game (e.g., paytable 202*b* illustrated in FIG. 5B). Accordingly, the gaming device 10 associates a paytable having an effective payout percentage of 92% with this play of the game.

The default payout display 132 displays the default payout percentage (e.g., 90%) to the player. By displaying the default percentage to the player, the gaming device 10 enables the player to compare the default payout percentage to any adjusted payout percentage received by the player's status or ranking. This can motivate players, which may cause those players to strive to achieve (or play up to) a higher status or ranking, and subsequently a higher average payout through increased play of the game.

The display device 16 or 18 displays an audio, visual, or audiovisual message indicating the player's status or ranking on the message display area 138. In one embodiment, the message display area 138 also indicates the payout percentage for that play of the game. In the example illustrated in FIG. 6B, the message display area 138 indicates "YOU ARE A VALUED BRONZE PLAYER! THE BRONZE PAYTABLE HAS AN AVERAGE EXPECTED PAYOUT OF 92%."

Figure 6C:
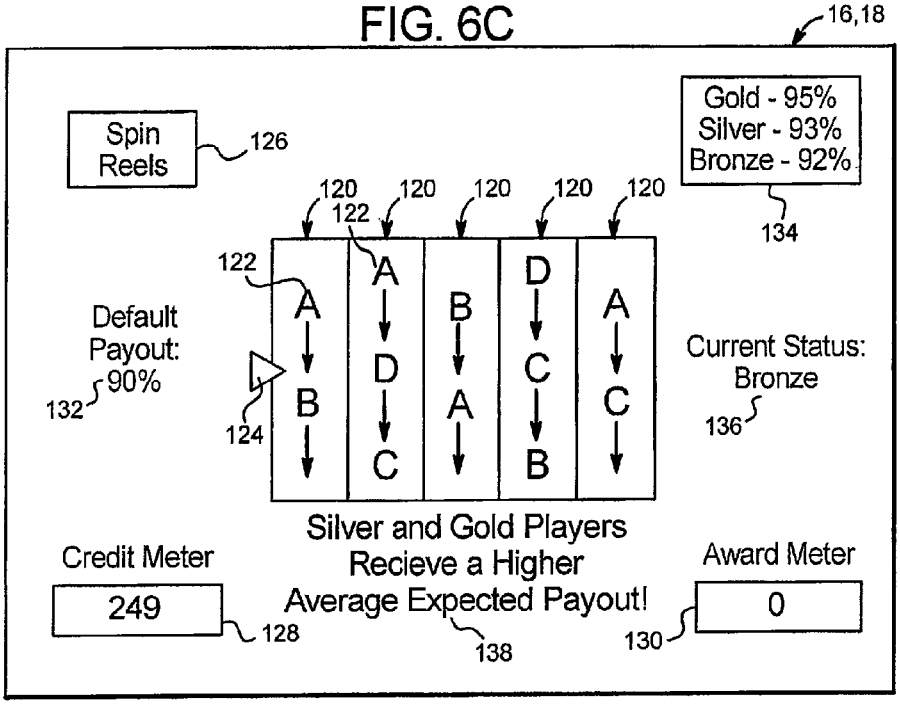

As illustrated in FIG. 6C, a player causes the reels 120 to spin by pressing the "SPIN REELS" button 126. In one embodiment, the gaming device 10 causes the message display area 138 to indicate a message relating to any higher or better payout percentages available for the game while the reels 120 are spinning. The message illustrated in FIG. 6C indicates "SILVER AND GOLD PLAYERS RECEIVE A HIGHER AVERAGE EXPECTED PAYOUT!" This message can motivate players or cause those players to strive to achieve a higher status or ranking and subsequently a higher average payout through increased play of the game.

Figure 6D:
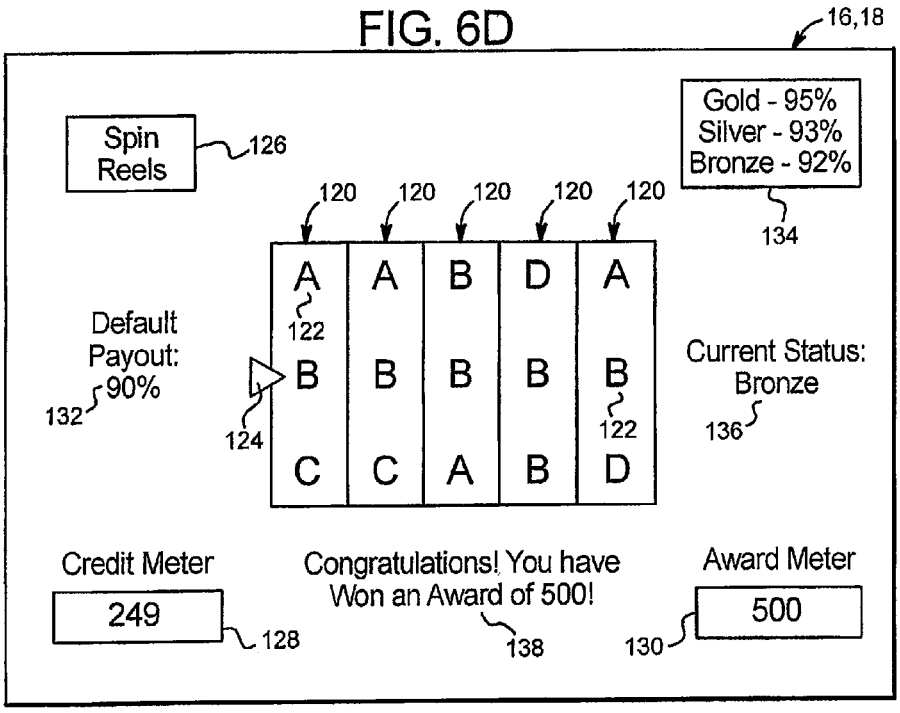

Referring now to FIG. 6D, the reels 120 have stopped so that one symbol 122 of each reel 120 is aligned with the payline indicator 124. The player used one credit to spin the reels 120, which causes the credit amount in the credit meter display 128 to decrease by one credit to two-hundred forty-nine. A symbol "B" is displayed on each of the reels 120. The payline indicator 124 indicates the symbol combination of "BBBBB" for this spin of the reels 120. The gaming device 10 evaluates the combination of symbols 122 indicated by the payline indicator 124 in accordance with the appropriate paytable 202*a*-202*d*. As described above, the gaming device 10 associated the paytable 202*b* with this spin of the reels 120 based on the player's bronze status or bronze ranking indicated by the current display 136. Accordingly, the gaming device 10 provides the player with an award amount of five-hundred for the symbol combination of "BBBBB" in accordance with the bronze paytable 202*b* illustrated in FIG. 5B. The award meter display 130 indicates that the player has obtained an award amount of five-hundred from this play of the game.

In one embodiment, the gaming device 10 causes the message display area 138 to indicate a message relating to any award amounts won by the player. For example, the message illustrated in FIG. 5D indicates "CONGRATULATIONS! YOU HAVE WON AN AWARD OF 500!" In one embodiment, the message display area 138 displays any award amount for the symbol combination associated with the payline indicator 124 from the default paytable and/or any other potential adjusted paytables. For example, the default paytable illustrated in FIG. 5A indicates that the symbol combination of "BBBBB" is associated with an award of 100. Accordingly, the message display area 138 could display a message indicating that the player's bronze status or ranking resulted in an increased award amount of four-hundred.

The above example describes how the gaming device 10 can provide a player with a higher award amount for one play of the game than would have been provided to the player with a default paytable. It should be appreciated that while the overall average payout percentage of an adjusted paytable is greater or less than the payout percentage of the default paytable, individual award amounts associated with these adjusted paytables may be increased or decreased as compared with the default paytable.

In this example, after the gaming device 10 generates an award and provides the generated award to the player, this play of the game ends. In one embodiment, the gaming device 10 determines whether the player has any credits remaining as indicated by the credit display meter 128. If the gaming device 10 determines that the player has credits remaining, the gaming device enables the player play a subsequent play of the game. Alternatively, the player may cash out any remaining credits and discontinue gaming. If the gaming device 10 determines that the player has no more credits remaining, the gaming device 10 enables the player to deposit an additional amount of money into the gaming device 10 to initiate a new gaming session.

For a subsequent play of the game, the gaming device 10 updates the player's status or ranking as indicated by the current display 136, if necessary, based on the previous play of the game or any other suitable factor. If the player's status or ranking does not change, the gaming device 10 will associate the same paytable (e.g., paytable 202*b*) with the subsequent play of the game. If the player's status or ranking does change (e.g., the player removes their player tracking card, or the player increases their player status or ranking), the gaming device 10 will associate a new paytable with the subsequent play of the game. This new paytable is based on the player's new status or ranking and any awards won in the game are paid in accordance with this new paytable.

The above example illustrated in FIGS. 6A to 6D shows how causing the gaming device to select a paytable and payout percentage based on a player's status or ranking increases the level of player excitement and enjoyment. In this example, the paytable associated with a bronze status or ranking, paytable 202*b* illustrated in FIG. 5B, includes a larger award for the symbol combination "BBBBB" than the default paytable, 202*a* illustrated in FIG. 5A. Therefore, the player's excitement builds as the player's status and ranking progresses because the potential for larger, and possibly more frequent, awards also builds. Additionally, by providing different paytables based on the player's status or ranking for a single game enables the game implementer to create a new impression for different players of the same game.

Award Sequences Having Variable Payout or Hold Amounts

In one embodiment, the variable payout and hold amounts described above are implemented in a server based environment. In one such embodiment, a central server, a central controller or remote host is in communication with or linked to a plurality of gaming machines or gaming devices at the same or different locations. In one embodiment, each of the linked gaming devices includes one or a plurality of primary games or secondary games. At least one of the gaming devices in the gaming system provides a variable payback or a variable hold through one or more award sequences.

In one embodiment, the variable payback is implemented through different award sequences having different average expected payouts. In one such embodiment, a gaming device in the gaming system employs an initial one of the award sequences. The gaming system enables the player to qualify for a different award sequence with a higher average expected payout or payback based on an individual ranking associated with the player. If the player qualifies for a different award sequence, the gaming system causes the gaming device to access the different award sequence. The gaming device then provides the player any awards based on the selected award sequence. In one embodiment, if the player does not qualify for a different award sequence, the gaming device employs the initial award sequence.

Figure 7:
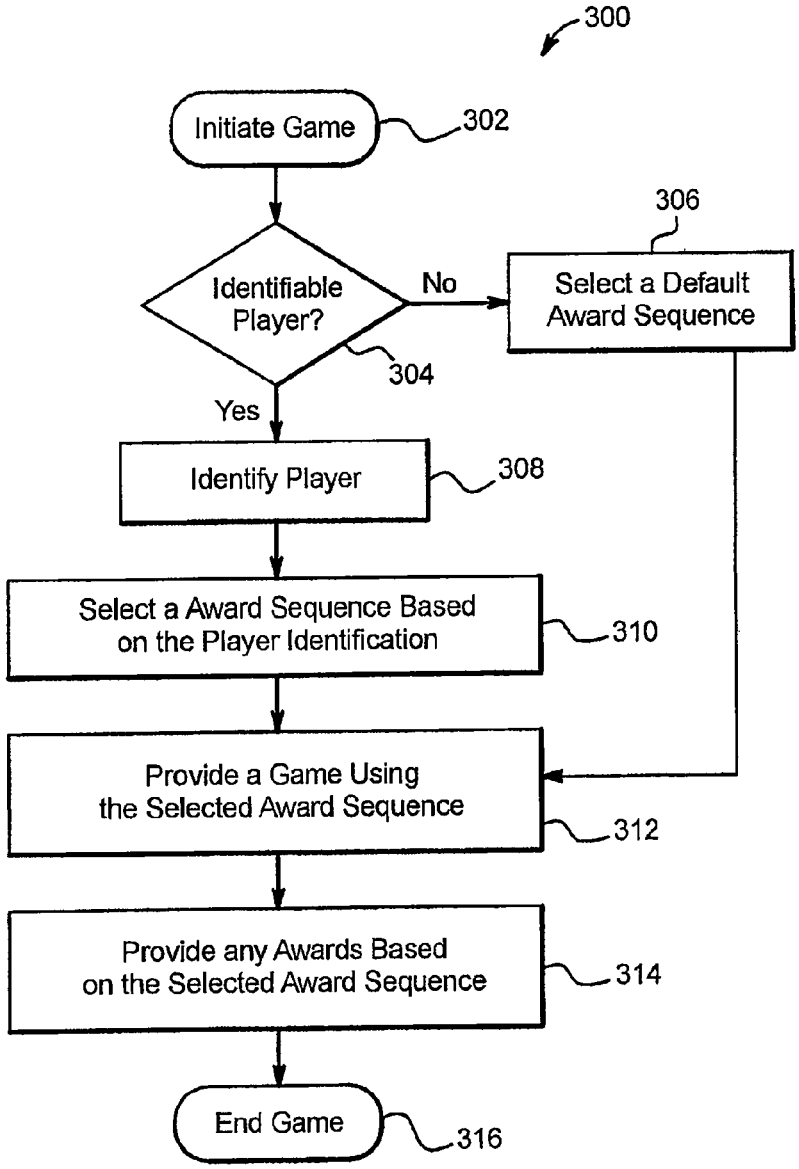
FIG. 7 is a process flow diagram showing one possible flow sequence of one embodiment of the present disclosure.

Referring now to FIG. 7, one embodiment of the present disclosure operates according to process 300. In one embodiment, the process 300 is embodied in one or more software programs stored in one or more memories and executed by one or more processors or controllers. Although the process 300 is described with reference to the flowchart illustrated in FIG. 7, it should be appreciated that many other methods of performing the acts associated with process 300 may be used. For example, the order of many of the blocks may be changed, and many of the blocks described may be optional.

In one embodiment, the central controller maintains an initial or default award sequence having an initial or a default average expected payback and one or more adjusted award sequences having an adjusted (e.g., increased) average expected payback. The central controller selects either the initial award sequence or one of the adjusted award sequences paytables based on the player's ranking or status (as determined by a suitable player tracking or player loyalty system).

In one embodiment, after a triggering event occurs at the gaming device, the central controller selects one of the award sequences to employ at the gaming device based on the player's ranking or status. The central controller communicates the appropriate data for the selected award sequence to the gaming device. The gaming device then provides the player the selected award sequence. Alternatively, the award sequences are stored by the gaming device in the gaming system and the central controller causes the gaming device to retrieve one of the stored award sequences based on the player's status or ranking.

As indicated by block 302 of the sequence 300, the gaming device enables the player to deposit an amount of money into the gaming device to initiate a gaming session. In one embodiment, when a player deposits money, the gaming device displays the amount on a credit meter or other suitable display. After receiving the money deposited by the player, the gaming device determines whether the player is identifiable via a player tracking system, as indicated by block 304.

In certain embodiments, a player begins a gaming session by inserting a playing tracking card, providing a pin code, or identifying himself or herself in any other suitable manner. The gaming device tracks the player's gaming activity at the gaming device and continuously updates the player's identification and ranking information in association with the tracked gaming activity.

In one embodiment, if a player is unidentifiable, the gaming device employs an initial or default award sequence for the game, as indicated by block 306. In one embodiment, the central controller causes the gaming device 10 to employ the default award sequence for the game. Unidentifiable players include uncarded players and unranked players. If the player is identifiable, as indicated by block 308, the gaming device and/or the central controller identifies the player in association with the player tracking system. In one such embodiment, the player tracking system communicates the player identification and ranking information associated with the player to the gaming device. In another embodiment, the player tracking system communicates the player identification and ranking information associated with the player to the central server, which communicates the player identification and ranking information to the gaming device. In either embodiment, the gaming device receives the player identification and ranking information directly or indirectly from the player tracking system.

As indicated by block 310, the central controller selects an award sequence based on the player identification and ranking information. In one embodiment, the gaming device enables different players with different player identification and ranking information to be eligible for different award sequences with different average expected paybacks. In one such embodiment, eligibility for certain award sequences is determined through the player tracking system. In this embodiment, different adjusted award sequences are associated with different player rankings or statuses. For example, a player with a first player ranking (e.g., no ranking) qualifies for the default award sequence having a first average expected payback (e.g., 90%). A player with a second ranking (e.g., bronze) qualifies for an adjusted award sequence having a second average expected payback (e.g., 92%). A player with a third ranking (e.g., silver) qualifies for an adjusted award sequence having a third average expected payback (e.g., 93%). A player with a fourth ranking (e.g., gold) qualifies for an adjusted award sequence having a fourth average expected payback (e.g., 95%).

In one embodiment, the award sequences are the same type of award sequence with different average expected paybacks. For example, each award sequence includes one or more spins of an award wheel, wherein each award wheel is associated with a different average expected payout. In another embodiment, the award sequences are different types of award sequences with different average expected paybacks. For example, a first award sequence is an offer and acceptance sequence having a first average expected payout and a second award sequence is a selection sequence having a second, different average expected payout. In one embodiment, the award sequences include different games and/or awards. The award sequence can be different based on the game played, or paytable data such as different symbol combinations, different values of multipliers, and different lengths of the multipliers.

Referring again to FIG. 7, after the gaming device and/or the central controller selects the appropriate award sequence based on the player identification and ranking information, the gaming device and/or the central controller provides the player with the selected award sequence, as indicated by block 312. In one embodiment, if the player did not qualify for one of the adjusted award sequences, the central controller causes the gaming device to employ the initial or default award sequence as indicated by block 312. In one embodiment, the default award sequence is stored by the gaming device. If the player qualified for one of the adjusted award sequences, the central controller enables the gaming device to access the selected adjusted award sequence to employ as indicated by block 312. In one embodiment, the adjusted award sequences are maintained by the central controller and communicated to one or more gaming devices over a suitable data network.

In one embodiment, the gaming device and/or the central controller determines an outcome for the award sequence. As illustrated by block 314, the gaming device and/or the central controller determines any awards associated with the determined award sequence outcome based on the selected award sequence and updates the credit meter to reflect credits won by the player, if any. As described above, the selected award sequence has a designated average expected payback based on the player identification and ranking information. In one embodiment, players with higher rankings qualify for award sequences with higher average expected paybacks.

After determining whether the player wins any awards based on the selected award sequence, the gaming device and/or the central controller determines whether the player has any credits remaining. If the gaming device determines that the player has credits remaining, the gaming device enables the player repeat sequence 300 beginning at block 302. Alternatively, the player may cash out any remaining credits and discontinue gaming, as indicated by block 316. If the gaming device determines that the player has no more credits remaining, the gaming device enables the player to deposit an additional amount of money into the gaming device to initiate a new gaming session and sequence 300 begins again starting at block 302.

It should be appreciated that the awards are adjustable in amount and triggering frequency to meet the level of the player's loyalty (i.e., the player's ranking). In one embodiment, frequent or loyal players (e.g., those players with a high ranking) are provided more frequent or larger awards than less frequent or loyal players (e.g., those players with a low ranking or no ranking). The amount and frequency of the awards contribute to the average expected payback of the selected award sequence.

In different embodiments, the central controller causes the gaming device to pool any awards for the selected award sequence based on the player's ranking or status. In one embodiment, the central server maintains an award pool that is associated with each player ranking. For example, the central controller maintains a first award pool for players who are uncarded or unidentifiable. The central controller also maintains separate award pools for each bronze, silver, and gold ranking.

In one embodiment, players having a designated status or ranking (e.g., bronze) are only eligible for the award pool maintained for that the designated player ranking (e.g., a bronze award pool). In another embodiment, players having a designated status or ranking (e.g., silver) are eligible for any award pool maintained for that the designated player ranking (e.g., a silver award pool) and any award pools maintained for a lower player ranking (e.g., an uncarded or unidentifiable player award pool and a bronze award pool). In one such embodiment, the player ranking serves as a minimum eligibility qualification for each award pool.

The central controller monitors the wagers that occur at each of the gaming devices in the gaming system. For each wager placed by a player, the central controller allocates a percentage of that wager to a designated pool for each specific player ranking. In one embodiment, the percentage of the player's wager that is allocated to the pool is equal to the average expected payback based on the player's ranking. For example, if players who have a bronze player ranking are provided with an award sequence having an average expected payout of 92%, then the central controller accrues 92% of these wagers in an award pool associated with the bronze player ranking. The 92% represents an increment rate for the award pool associated with the bronze player ranking. In another embodiment, the percentage of the player's wager that is allocated to the pool is equal to the average expected payback based on the player's ranking (e.g., 92%) minus a default average expected payback (e.g., 90%). In one such embodiment, the increment rate is 2% for the award pool associated with the bronze player ranking.

In one embodiment, the central controller monitors each award pool over a designated time period so that each pool remains at an average level. In one embodiment, the average level is zero. By maintaining each pool at the average level, the central controller ensures that the overall payback percentage paid to each player ranking is equal to the increment rate. That is, the central controller monitors each award pool in order to prevent one or more of the award pools from substantially growing or shrinking over the designated time period.

In one embodiment, the central controller provides the award pool (or a portion thereof) to one or more players associated with that pool based on a suitable triggering event. The triggering event may be determined based on a predetermined event, a random event, a designated wager level, a designated number of games, the player's ranking, time, or determined in any other suitable manner.

In another embodiment, the central controller provides a designated percentage of the award pool to one or more players associated with that pool based upon the size of the pool. For example, if the award pool that is associated with a silver player status increases to a predetermined threshold amount, the central controller determines to provide a designated portion of the silver award pool to one or more players in the gaming system having a silver player ranking or status, or at least a silver player ranking or status.

In another embodiment, the central controller awards a percentage of the pool to one or more players associated with that pool based on a rate of growth of a size of the pool. In one embodiment, the central controller awards a randomly selected amount to one or more players associated with that pool, wherein the expected value of the award amount is a function of either the size of the pool or the rate of growth of the pool.

In another embodiment, the central controller keeps the award size constant, but changes the award frequency based on the pool size or the rate of change of the pool size, in order to maintain the award pool at an average size. In one embodiment, the average size is zero. The award frequency enables the gaming establishment to provide a designated percentage of the award pool to specific players so that the pool size or the growth rate of the pool remains substantially at the designated average level or value.

In one embodiment, the central controller maintains a pool for each specific player instead of each specific player ranking. In this embodiment, the central controller accrues a percentage of each wager made by a player into an award pool for that specific player during that player's gaming session. The accrual percentage is based on the player's status or ranking as described above. In one embodiment, the central controller offers the player a temporary upgrade or level increase to the player's ranking based on that player's wager history, play history, shopping history, or any other suitable information tracked about the player. For instance, if the player generally plays $1 per play gaming devices, and starts to play a $5 per play gaming device, the central controller may send a message to that player's gaming device offering that player a silver ranking or status as incentive to keep the player playing the $5 per play gaming device.

In another embodiment, the central controller provides a designated amount of the pool (or the entire pool) to the player associated with that pool based on a suitable triggering event. The triggering event may be determined based on a predetermined event, a random event, a designated wager level, a designated number of games, the player's ranking, time, or determined in any other suitable manner.

It should be appreciated that the awards provided by the central controller and/or the gaming device may be any suitable awards such as values, credits, coupons, points, or promotions (e.g., lower interest rates or discounts on items at the gaming establishment). The awards may also include free spins, free games, multipliers, progressive awards, additional game symbols or symbol combinations, award opportunities, incrementing values for other awards (e.g., progressive awards) or any other suitable award as desired by the game implementer.

It should be appreciated that the variable payback and hold amounts of the present disclosure could be employed in other games such as poker, blackjack, keno and other primary or secondary games. For example, in another embodiment of the present disclosure (not shown), the gaming device includes a selection game. The gaming device provides a selection set which includes a plurality of selections. Each of the selections is individually associated with an award so that the selection set is associated with a default average expected payback (e.g., 90%). The gaming device enables the player to pick a selection to obtain the award associated with that selection. Based on the player's ranking or status, the award may have a different value. For example, the selection set is associated with an average expected payback that is equal to or higher than the default payback based on the player's ranking or status. If the player's ranking or status is bronze, for example, the selection set is associated with an average expected payback that is higher than the default payback. If the player is unranked or is unidentifiable, for example, the selection set is associated with an average expected payback that is equal to the default payback. The gaming device determines the award amount based on the average expected payback of the selection set and provides the determined award amount to the player. In one embodiment, the gaming device provides the player with a limited number of opportunities to pick selections from the selection set. The number of opportunities provided to the player may be predetermined, randomly determined, determined based on the player's wager, determined based on the player's status (via a player tracking system), determined based on a triggering event, determined based on time, or determined in any other suitable manner. In one embodiment, the player's status or ranking influences the selections that the player can select. That is, the availability or unavailability of certain selections is based on the player status or ranking of the identified player.

In one embodiment, the gaming system disclosed herein contemplates employing one or more displays to provide the players of the gaming machines in the gaming system information about the different average expected paybacks or the different average expected holds. This displayed information increases player's awareness of these expected values and increases interaction between players of the gaming machines. The display(s) provide any suitable information about the gaming system, gaming machines, average expected paybacks and average expected holds. For example, the display(s) are configured to display a plurality of player rankings or player tracking statuses in association with a plurality of average expected paybacks or average expected holds. In one embodiment, the central controller communicates information to the players via one or more tracking meters on each separate machine, on an overhead sign that is common to all machines in the bank and/or on one or more signs which are not associated with any gaming machines in the gaming system (such as signs placed anywhere in the gaming establishment).

Equalization

In various embodiments described above, the central controller or server interacts with one or more gaming devices to implement a variable payback percentage (or hold amount) based on a player's identification, ranking, or status. Promotions implementing the variable payback percentage (or hold amount) based on a player's identification, ranking, or status increase the excitement and entertainment level of the player.

In one embodiment, the central controller is configured to target specific players who will receive a tangible benefit from such promotions. In one embodiment, the casino or gaming establishment (and/or the central controller) chooses specific players based on each of the player's play history, player ranking, player tracking point history, player status, or any other suitable player identification. For example, the casino or gaming establishment may choose to target players with at least gold rankings or statuses (i.e., gold players and above) because of each player's history of being a great customer. In one example, the central controller is configured to provide a gold player (or above) with a free spin for every $10^{th}$ game played by that player. By providing a tangible benefit (e.g., one free spin for every $10^{th}$ game) to the player, the player recognizes and appreciates a change in their gaming experience. Thus, in one embodiment, the disclosed gaming system and method uses a reward mechanism wherein players recognize a tangible change in the game, and that the players win opportunities for such tangible change.

It should be appreciated that other tangible benefits could be used to provide the player with an additional winning opportunity. For example, the central controller of the gaming system and/or the processor of the gaming device is configured to provide a player with an additional winning opportunity in the form of a multiplier or other suitable bonus type event.

The casino or game operation can use the variable average expected payback percentages described above to enhance the overall gaming experience for a player. In one embodiment, the gaming system and method includes equalized bonus modes and events, which are based on player selection and recognition as described in detail below.

In one embodiment, each individual game has a respective bonus mode that reacts differently to different ranked players or players with different statuses. This includes offering different bonus awards to the different players based on player tracking point history, or any other suitable player history, ranking, status, or identification. In a first example, the bonus does not change if an un-carded or low-level player (e.g., a bronze ranked player) reaches a bonus mode. However, if a high-level player (e.g., a platinum or gold ranked player) reaches the bonus mode, the bonus mode can inject higher percentage payouts for the high-level player. This raises the overall payback percentage for the gaming device played by the high-level player. Thus, each bonus mode in the game is driven by, or at least partially based on, the identification, ranking, status, or history of the player at the gaming machine providing that game and bonus mode.

In a different embodiment, each gaming device in the gaming system is associated with a base game. In such an embodiment, each base game is set to a certain default payback percentage defined by a paytable associated with that base game. The casino or gaming establishment implements a promotion in which the payback percentage for gold ranked players (or higher) is set to 95%. To accomplish this 95% payback percentage, the central controller is configured to cooperate with the base game at the gaming device to determine a bonus event based on the player's status, ranking, identification or history playing at that gaming device. That is, when a bonus mode of the base game is triggered, the central controller and/or the processor of the gaming device is configured to identify when the base game is going to enter into the bonus mode. In one embodiment, the gaming device queries the central controller before the bonus mode is enacted or initiated and the central controller determines a bonus event based on the player's status, ranking, identification or history. In another embodiment, the gaming device queries the central controller after the bonus mode is enacted or initiated and the central controller determines a bonus event based on the player's status, ranking, identification or history before an ending or result of the bonus mode.

In one embodiment, if the player is un-carded or unidentified, the bonus will be played, but no additional features will be applied to the game. For example, if the bonus game is a free spin game of ten free spins, the player will receive their ten free spins and the bonus game will commence. However, if the player is a gold ranked player and gold ranked players receive an additional payback percentage to bring the game to a 95% payback, the game will provide them with additional features in the bonus game. For example, the gold ranked players may receive a set number of additional free spins that equate to the payback percentage difference (between each of the gold ranked player's current base game and 95%). Alternatively, the gold ranked players may receive multiplied outcomes to make up the difference (between each of the gold ranked player's current base game and 95%). Otherwise, the gold ranked players may receive any other bonus feature desired by the game operator to accommodate the difference (between each of the gold ranked player's current base game and 95%).

In the above-described embodiments, each game includes a theme, symbols, volatility, math (or probabilities), and other features. The bonus modes of such games, if any, operate in accordance with the central controller. In one embodiment, the game is hard-coded to request and receive data from the central controller at a bonus event of a game, and apply the received data to the bonus event of the game. In operation of each base game throughout the gaming system, each base game includes an algorithm that equalizes how the bonus is applied. In other words, the game identifies what type of game it is and thus what type of bonus event it needs. The central controller determines the outcome based on the game type information sent by the gaming device.

For example, if a bonus event triggering event occurs in a base game, the gaming device associated with the base game sends a message including game type information to the central controller. The message essentially says "I am game type X, I need outcome Y". The central controller determines the outcome based on the game type information sent by the gaming device. That is, the type of outcome is based on the game type information received by the central controller. In one embodiment, the central controller is configured to select one of a plurality of different possible responses or outcomes based on the game type. These possible responses or outcomes can be stored in a table that the central controller is configured to access for further instruction (i.e., a look-up table). In one embodiment, the table is partitioned into different sectors based on the different game types. For example, the table sector X corresponds to game type X and provides a number of different responses or outcomes that can be provided to game type X in a bonus mode. The table sector Y corresponds to game type Y and provides a number of different responses or outcomes that can be provided to game type Y in a bonus mode. Even if game type X and game type Y are two different game types (in terms of a selected game factor, such as a bonus hit frequency or any other suitable factor or characteristic), the central controller will return outcomes with equalized payouts so that both game types X and Y are increased by the proper payback percentage amount over time regardless of their different characteristics.

In the above example, a fixed amount of the different possible responses or outcomes for a game or game type are predefined as "bonus" or "central controller query" outcomes. Such "bonus" or "central controller query" outcomes have a predetermined value, which is augmented by the ranking, status, identification or history of the player at the gaming machine (to increase the payback percentage as desired by the gaming establishment or gaming operation). For simplicity of this example, the predetermined values are low, medium or high.

(A) Gaming Machine A has been defined to have 4 low value bonus events.

(B) Gaming Machine B has been defined to have 1 high value bonus event and 1 medium value bonus event.

(C) Gaming Machine C has been defined to have 3 medium value bonus events.

Such bonus events have a look and play style that is unique to the game, but the average expected payback percentage of the outcomes are predefined. The outcomes are predefined by the low, medium, or high value ranges. When the game results in one of the low, medium or high outcomes, the gaming device requests the bonus value from the central controller. The bonus value is determined (in order to add to the payback percentage for the specific players designated by the central controller and/or the casino or gaming establishment). In one embodiment, the central controller is configured to determine the bonus value based on which of the low, medium or high outcomes hit or occurred in the game.

For example, the central controller receives a message or input from gaming machine A that a low-value bonus event has hit. The message or input includes the ranking, status, identification, or history for the player at gaming machine A. In this example, the player at gaming machine A is a platinum ranked player. In one embodiment, low-value bonus awards are modified or augmented for platinum players so the central controller returns a "multiplier" to augment the bonus value. In this example, the multiplier is "100×" based on the platinum ranking of the player. Accordingly, the player at gaming machine A is provided with a low-value bonus award multiplied by 100 times.

The central controller receives a message or input from gaming machine B that a high-value bonus event has hit. The message or input includes the ranking, status, identification, or history for the player at gaming machine B, which is gold in this example. In one embodiment, high-value bonus awards are slightly modified or augmented for gold ranked players so the central controller returns a "multiplier" to augment the bonus value. In this example, the multiplier is "5×" based on the gold ranking of the player. Accordingly, the player at gaming machine B is provided with a high-value bonus award multiplied by 5 times.

The central controller receives a message or input from gaming machine C that a medium-value bonus event has hit. The message or input includes the ranking, status, identification, or history for the player at gaming machine C, which is uncarded or unidentified in this example. In one embodiment, medium-value bonus awards would be modified or augmented for all carded players except bronze ranked players. Since the player at gaming machine C is not carded or identified, the central controller returns no "multiplier" to the gaming device. Accordingly, the player at gaming machine C is provided with a medium-value bonus award. It should be appreciated that the player at gaming machine C would also be provided with the medium-value bonus award if player C was a bronze ranked player in this example since the medium-value bonus awards are modified or augmented for all carded players except bronze ranked players.

It should be appreciated that the "multiplier" described above is representative of any aspect of a primary game or bonus game associated with the gaming system. For example, the "multiplier" can be anything from a greater number of spins, a pool of higher values to pick from, more picks or selections, less terminator symbols, an actual multiplier, or any additional special feature desired by the game implementer or designer. For example, the "multiplier" can be but is not limited to, (1) at least one displayed paytable associated with the game being played by the player, (2) at least one mapping of a paytable associated with the game being played by the player, (3) at least one award sequence associated with the game, (4) an eligibility to play the game, (5) at least one additional chance in either the primary game or the bonus game associated with the gaming machine, such as free spins in a reel game, additional selections in a selection game, or free cards or draws in a poker game, (6) at least one additional chance to win an award, such as a mystery award, which may or may not be associated with, or dependent on, either the primary game or the bonus game associated with the gaming machine, (7) an increased frequency of awards for either the primary game or the bonus game associated with the gaming machine, (8) an increased size of awards for either the primary game or the bonus game associated with the gaming machine, (9) at least one advantage or additional feature in either the primary game or bonus game associated with the gaming machine, such as providing an additional pick or a hint in a selection game, or by reducing a threshold for a player to qualify for a certain game round or game award (i.e., the top level progressive award in a multi-level progressive game), (10) at least one additional symbol or symbol combination (e.g., physical or virtual) in either the primary game or the bonus game associated with the gaming machine, (11) at least one additional winning outcome for either the primary game or the bonus game associated with the gaming machine, (12) at least one changed pay value associated with at least one of the symbols or symbol combinations in either the primary game or the bonus game associated with the gaming machine, (13) a different or modified primary game or bonus game associated with the gaming machine, wherein such different primary game includes a different theme, different symbols, a different volatility, and/or a different paytable as the original primary game, (14) a display caused by a server or central controller, wherein such display by a service window associated with the server causes a notification to the player of a changed payback percentage (or hold percentage) associated with either the primary game or the bonus game associated with the gaming machine, (15) at least one symbol overlay, such as a double symbol or a changed symbol for either the primary game or the bonus game associated with the gaming machine, (16) enabling one or more progressive awards associated with either the primary game or the bonus game associated with the gaming machine, (17) an increment rate of one or more progressive awards associated with either the primary game or the bonus game associated with the gaming machine, and (18) any combination thereof. Since the bonus modes or games are built from predefined sets of rules, the central controller knows what actions or instructions to perform to augment bonus X by "multiplier" Y, regardless of which of the above-described forms the "multiplier" takes.

It should also be appreciated that the variable payback and hold amounts of the present disclosure could be employed as actual wins instead of being based on theoretical wins for any of the embodiment described above. It should be understood that actual wins include determined or accrued amounts of money paid back to a player and that theoretical wins include variable amounts of money paid back to the player over time.

While the present disclosure is described in connection with what is presently considered to be the most practical and preferred embodiments, it should be appreciated that the present disclosure is not limited to the disclosed embodiments, and is intended to cover various modifications and equivalent arrangements included within the spirit and scope of the claims. Modifications and variations in the present disclosure may be made without departing from the novel aspects of the invention as defined in the claims, and this application is limited only by the scope of the claims.

The invention is claimed as follows:

1. A gaming system comprising:

at least one display device configured to display a primary game which is playable with one of:

(i) a first paytable having a first average expected return and including one or more first winning outcomes each associated with one of one or more first monetary awards; and (ii) a second paytable having a second average expected return and including one or more second winning outcomes each associated with one of one or more second monetary awards, the second paytable being different from the first paytable and the second average expected return being different from the first average expected return;

at least one input device;

at least one processor; and at least one memory device which stores a plurality of instructions which, when executed by the at least one processor, cause the at least one processor to operate with the at least one display device and the at least one input device to:

(a) receive a wager amount placed by a player for at least one play of the primary game;

(b) cause a determination of a rank of the player, the rank of the player determined regardless of ranks of any other players;

(c) if the determined rank of the player is less than a first rank, select the first paytable for the at least one play of the primary game for the player;

(d) if the determined rank of the player is at least equal to the first rank, select the second paytable for the at least one play of the primary game for the player;

(e) for each of the at least one play of the primary game:

(i) display said play of the primary game employing the selected paytable;

(ii) display an outcome for said play of the primary game; and (iii) if said displayed outcome is one of the one or more winning outcomes of the employed paytable, in accordance with the employed paytable, display the monetary award associated with said displayed winning outcome, said displayed monetary award being in addition to player tracking points, if any, provided to the player based on the wager amount; and (f) if a bonus triggering event occurs:

(i) if the determined rank of the player is less than the first rank, display a play of a first bonus game, determine any first bonus awards associated with said play of the first bonus game, and display any determined first bonus awards; and (ii) if the determined rank of the player is at least equal to the first rank, display a play of a second bonus game, determine any second bonus awards associated with said play of the second bonus game, and display any determined second bonus awards, wherein the second bonus game includes at least one feature not included in the first bonus game.

2. The gaming system of claim 1, wherein the plurality of instructions, when executed by the at least one processor, cause the at least one processor to operate with the at least one display device to display the employed paytable for each of the at least one play of the primary game.

3. The gaming system of claim 1, wherein the plurality of instructions, when executed by the at least one processor, cause the at least one processor to operate with the at least one display device to: (i) display the first average expected return for each of the at least one play of the primary game if the determined rank of the player is less than the first rank, and (ii) display the second average expected return for each of the at least one play of the primary game if the determined rank of the player is at least equal to the first rank.

4. The gaming system of claim 1, wherein the plurality of instructions, when executed by the at least one processor, cause the at least one processor to operate with the at least one display device to display the first average expected return and the second average expected return for each of the at least one play of the primary game.

5. The gaming system of claim 1, wherein the plurality of instructions, when executed by the at least one processor, cause the at least one processor to operate with the at least one display device to: (i) display a condition associated with the first rank if the determined rank of the player is less than the first rank; (ii) display information for satisfying the displayed condition; and (iii) if the displayed condition is satisfied, change the determined rank of the player to the first rank for at least one subsequent play of the primary game for the player.

6. The gaming system of claim 1, wherein the plurality of instructions, when executed by the at least one processor, cause the at least one processor to operate with the at least one display device to: (i) display a condition associated with at least one designated rank, the designated rank being higher than the determined rank of the player; (ii) display information for satisfying the displayed condition; and (iii) if the displayed condition is satisfied, change the determined rank of the player to the designated rank for at least one subsequent play of the primary game for the player.

7. The gaming system of claim 1, which includes a player tracking system configured to operate with the at least one processor.

8. The gaming system of claim 7, wherein the plurality of instructions, when executed by the at least one processor, cause the at least one processor to operate with the player tracking system to determine the rank of the player.

9. The gaming system of claim 7, wherein the plurality of instructions, when executed by the at least one processor, cause the at least one processor to receive the determined rank of the player from the player tracking system, and wherein the paytable is selected based on the determined rank of the player received from the player tracking system.

10. The gaming system of claim 1, wherein the plurality of instructions, when executed by the at least one processor, cause the at least one processor to operate with the at least one display device to display: the first paytable, the first average expected return, the second paytable, and the second average expected return.

11. The gaming system of claim 1, wherein the one or more first winning outcomes and the one or more second winning outcomes each include a plurality of symbol combinations, the first paytable including an association between a first symbol combination and a first one of the first monetary awards and the second paytable including an association between the first symbol combination and a first one of the second monetary awards, the first one of the first monetary awards and the first one of the second monetary awards being different.

12. The gaming system of claim 11, wherein the second paytable includes an association between a second different symbol combination and the first one of the second monetary awards.

13. The gaming system of claim 1, wherein at least one of the one or more first winning outcomes differs from at least one of the one or more second winning outcomes.

14. The gaming system of claim 1, wherein the first paytable includes a first quantity of the one or more first winning outcomes for each of the at least one play of the primary game, and the second paytable includes a second different quantity of the one or more second winning outcomes for each of the at least one play of the primary game.

15. The gaming system of claim 1, wherein at least one of the one or more second winning outcomes is associated with a first symbol being positioned to overlay a second different symbol.

16. The gaming system of claim 1, wherein the second average expected return is associated with an eligibility for: (i) the at least one play of the primary game, (ii) at least one subsequent play of the primary game, or (iii) at least one play of another different game.

17. The gaming system of claim 1, wherein the second average expected return is associated with at least one opportunity to win another one of the one or more second monetary awards independent from the at least one play of the primary game.

18. The gaming system of claim 1, wherein the first paytable is associated with a first frequency of winning any first monetary awards for the at least one play of the primary game, and the second paytable is associated with a second higher frequency of winning any second monetary awards for the at least one play of the primary game.

19. The gaming system of claim 1, wherein the one or more first monetary awards are different than the one or more second monetary awards for the at least one play of the primary game, at least one of the one or more second monetary awards being larger than at least one of the one or more first monetary awards.

20. The gaming system of claim 1, wherein the first average expected return is associated with a first threshold to qualify for a subsequent play of the primary game, and the second average expected return is associated with a second different threshold to qualify for the subsequent play of the primary game.

21. The gaming system of claim 1, wherein the second paytable is associated with at least one play of another different game.

22. The gaming system of claim 1, wherein the second paytable is associated with at least one progressive award, the at least one progressive award being available to be provided to the player based on the determined rank of the player.

23. The gaming system of claim 1, wherein the second paytable is associated with at least one progressive award associated with the at least one play of the primary game, the at least one progressive award incrementing based on the determined rank of the player.

24. The gaming system of claim 1, wherein the second average expected return is higher than the first average expected return.

25. The gaming system of claim 1, wherein the second average expected return is higher than the first average expected return by a designated amount, the designated amount based on the determined rank of the player.

26. The gaming system of claim 1, wherein the primary game is playable with at least one third paytable having a third average expected return, the third paytable being different from the first and second paytables, and the third average expected return being different from the first and second average expected returns.

27. The gaming system of claim 26, wherein the third average expected return is higher than the first average expected return and higher than the second average expected return.

28. The gaming system of claim 1, wherein the second paytable provides at least one advantage over the first paytable, said at least one advantage selected from the group consisting of: (i) higher available monetary awards to be won, (ii) higher available multipliers to be applied, (iii) random multipliers to be applied, (iv) a different number of available winning symbol combinations, (v) different types of available winning symbol combinations, (vi) a different number of available symbols; (vii) different types of available symbols; and (viii) a different proportion of available symbols.

29. The gaming system of claim 1, wherein each of the first winning outcomes and each of the second winning outcomes is one of a plurality of combinations of indicia.

30. The gaming system of claim 1, wherein an average expected return of the second bonus game is greater than an average expected return of the first bonus game.

31. A gaming system comprising:

at least one display device configured to display a primary game which is playable with one of a plurality of different paytables, each paytable having:

(i) one or more winning outcomes each associated with one of one or more monetary awards, and (ii) one of a plurality of different average expected returns;

at least one input device;

at least one player tracking system configured to determine a rank of a player of the primary game, the rank of the player determined regardless of ranks of any other players;

at least one processor; and at least one memory device which stores a plurality of instructions which, when executed by the at least one processor, cause the at least one processor to operate with the at least one display device, the at least one input device, and the at least one player tracking system to:

(a) receive the determined rank of the player for at least one play of the primary game;

(b) if the determined rank of the player is a first rank, select a first one of the paytables for the at least one play of the primary game for the player, the first paytable having a first one of the average expected returns;

(c) if the determined rank of the player is a second different rank, select a second different one of the paytables for the at least one play of the primary game for the player, the second paytable having a second different one of the average expected returns;

(d) for each of the at least one play of the primary game:

(i) display said play of the game employing the selected paytable;

(ii) display an outcome for said play of the game; and (iii) if said displayed outcome is one of the one or more winning outcomes associated with the employed paytable, in accordance with the employed paytable, display the monetary award associated with said displayed winning outcome, said displayed monetary award being in addition to player tracking points, if any, provided to the player based on any wager placed on said play of the game; and (e) if a bonus triggering event occurs:

(i) if the determined rank of the player is less than the first rank, display a play of a first bonus game, determine any first bonus awards associated with said play of the first bonus game, and display any determined first bonus awards; and (ii) if the determined rank of the player is at least equal to the first rank, display a play of a second bonus game, determine any second bonus awards associated with said play of the second bonus game, and display any determined second bonus awards, wherein the second bonus game includes at least one feature not included in the first bonus game.

32. The gaming system of claim 31, wherein the plurality of instructions, when executed by the at least one processor, cause the at least one processor to assign the first rank to any player who is not registered with the at least one player tracking system.

33. The gaming system of claim 32, wherein the plurality of instructions, when executed by the at least one processor, cause the at least one processor to assign the second rank to any player who is registered with the at least one player tracking system.

34. The gaming system of claim 31, wherein the plurality of instructions, when executed by the at least one processor, cause the at least one processor to operate with the at least one display device to, for each of the at least one play of the primary game, display the employed paytable.

35. The gaming system of claim 31, wherein the second average expected return is higher than the first average expected return.

36. The gaming system of claim 31, wherein the second average expected return is higher than the first average expected return by a designated amount, the designated amount being based on the determined rank of the player.

37. The gaming system of claim 31, wherein, for each paytable, each of the winning outcomes of said paytable is one of a plurality of combinations of indicia.

38. The gaming system of claim 31, wherein an average expected return of the second bonus game is greater than an average expected return of the first bonus game.

39. A gaming system comprising:

at least one display device;

at least one input device;

at least one processor; and at least one memory device which stores a plurality of instructions which, when executed by the at least one processor, cause the at least one processor to operate with the at least one display device and the at least one input device to:

(a) receive a wager amount for a play of a primary game, the wager amount being placed by a player;

(b) cause a determination of a rank of the player for the play of the primary game, the rank of the player determined regardless of ranks of any other players;

(c) if the determined rank of the player is a first rank, select a first paytable having a first average expected return and including one or more first winning outcomes each associated with one of one or more first monetary awards;

(d) if the determined rank of the player is a second different rank, select a second paytable having a second average expected return and including one or more second winning outcomes each associated with one of one or more second monetary awards, the second paytable being different from the first paytable and the second average expected return being different from the first average expected return;

(e) in accordance with the selected paytable:

(i) display the play of the primary game in accordance with the selected paytable;

(ii) display an outcome for the play of the primary game; and (iii) if said displayed outcome is one of the one or more winning outcomes of the selected paytable, display the monetary award associated with said displayed winning outcome, said displayed monetary award being in addition to player tracking points, if any, provided to the player based on the wager amount; and (f) if a bonus triggering event occurs:

(i) if the determined rank of the player is less than the first rank, display a play of a first bonus game, determine any first bonus awards associated with said play of the first bonus game, and display any determined first bonus awards; and (ii) if the determined rank of the player is at least equal to the first rank, display a play of a second bonus game, determine any second bonus awards associated with said play of the second bonus game, and display any determined second bonus awards, wherein the second bonus game includes at least one feature not included in the first bonus game.

40. The gaming system of claim 39, wherein the rank of the player is determined based on an amount of the primary games played by the player.

41. The gaming system of claim 39, wherein the rank of the player is determined based on a designated rate at which an amount of the primary games are played by the player.

42. The gaming system of claim 39, wherein the rank of the player is determined based on time.

43. The gaming system of claim 39, wherein the rank of the player is determined based on an amount of the primary games played by the player in a designated amount of time.

44. The gaming system of claim 39, wherein the rank of the player is determined based on a criteria tracked in association with the player by a player tracking system.

45. The gaming system of claim 39, wherein the rank of the player is determined based on the primary game played.

46. The gaming system of claim 39, wherein the rank of the player is determined based on an amount won over a designated number of the primary games played by the player or an amount lost over a designated number of the primary games played by the player.

47. The gaming system of claim 39, wherein the rank of the player is determined based on a number of visits to at least one designated gaming establishment.

48. The gaming system of claim 39, wherein the rank of the player is determined based on an amount of purchases made in association with at least one designated gaming establishment.

49. The gaming system of claim 39, wherein each of the first winning outcomes conditions and each of the second winning outcomes conditions is one of a plurality of combinations of indicia.

50. The gaming system of claim 39, wherein an average expected return of the second bonus game is greater than an average expected return of the first bonus game.

* * * * *

UNITED STATES PATENT AND TRADEMARK OFFICE

CERTIFICATE OF CORRECTION

PATENT NO. : 8,992,306 B2
APPLICATION NO. : 12/147225
DATED : March 31, 2015
INVENTOR(S) : Cara L. Iddings et al.

It is certified that error appears in the above-identified patent and that said Letters Patent is hereby corrected as shown below:

IN THE CLAIMS

In Claim 31, Column 53, Line 59, between the first instance of "the" and "game" insert --primary--.
In Claim 31, Column 53, Line 61, between "the" and "game" insert --primary--.
In Claim 31, Column 54, Line 3, before "game" insert --primary--.
In Claim 49, Column 56, Line 26, delete "conditions".
In Claim 49, Column 56, Line 27, delete "conditions".

Signed and Sealed this
Fifteenth Day of September, 2015

Michelle K. Lee

Michelle K. Lee
*Director of the United States Patent and Trademark Office*